US009815670B2

(12) United States Patent
Bauder

(10) Patent No.: US 9,815,670 B2
(45) Date of Patent: Nov. 14, 2017

(54) WINCH FOR PROVIDING A PART OF UNWOUND CABLE WITH A PREDETERMINED LENGTH

(76) Inventor: Christopher Bauder, Berlin (DE)

( * ) Notice: Subject to any disclaimer, the term of this patent is extended or adjusted under 35 U.S.C. 154(b) by 223 days.

(21) Appl. No.: 13/994,816

(22) PCT Filed: Dec. 15, 2011

(86) PCT No.: PCT/EP2011/072911

§ 371 (c)(1),
(2), (4) Date: Sep. 11, 2013

(87) PCT Pub. No.: WO2012/084685

PCT Pub. Date: Jun. 28, 2012

(65) Prior Publication Data

US 2014/0145129 A1 May 29, 2014

(30) Foreign Application Priority Data

Dec. 20, 2010 (EP) ..... 10195881

(51) Int. Cl.
*B66D 1/26* (2006.01)
*B66D 1/46* (2006.01)
(Continued)

(52) U.S. Cl.
CPC ..... *B66D 1/46* (2013.01); *B66D 3/18* (2013.01); *F21V 21/16* (2013.01); *F21V 21/38* (2013.01);
(Continued)

(58) Field of Classification Search
CPC . B66D 1/26; B66D 1/485; B66D 1/50; B66D 1/505; B66D 1/52; B66D 1/525;
(Continued)

(56) References Cited

U.S. PATENT DOCUMENTS 647,239 A * 4/1900 Sprague ..... B23Q 5/56
188/77 R
1,168,397 A * 1/1916 Johnston ..... A61B 6/105
254/283
(Continued)

FOREIGN PATENT DOCUMENTS

DE 29807516 U1 10/1998
JP 10241448 A 11/1998
(Continued)

OTHER PUBLICATIONS

PCT International Search Report dated Feb. 17, 2012, Appliction No. PCT/EP2011/072911, Applicant Christopher Bauder, 4 Pages.
(Continued)

*Primary Examiner* — Emmanuel M Marcelo
*Assistant Examiner* — Michael Gallion
(74) *Attorney, Agent, or Firm* — Brooks Kushman P.C.

(57) ABSTRACT

A winch comprises a cable roll; a cable having one end fixed to the cable roll and another end configured to electrically connect an electric device to the cable, wherein the cable is further configured to provide the electric device with electric power and/or with data; a framework to which the cable roll is mounted; measuring means connected to the framework and configured to provide data related to the length of an unwound part of the cable; and processing means configured to control winding and unwinding of the cable based on data provided by the measuring means. The cable has a predetermined reference state at which a predetermined fixed reference point is at a reference position in relation to a coordinate system, wherein the length of unwound cable is defined as the distance measured along the cable, between the location of the predetermined fixed reference point and the reference position.

19 Claims, 14 Drawing Sheets

(51) Int. Cl.

| | |
|---|---|
| ***B66D 3/18*** | (2006.01) |
| ***F21V 21/16*** | (2006.01) |
| ***F21V 21/38*** | (2006.01) |
| ***F21V 27/00*** | (2006.01) |
| *F21Y 103/00* | (2016.01) |

(52) U.S. Cl.
CPC ..... *F21V 27/00* (2013.01); *B66D 1/26* (2013.01); *F21Y 2103/00* (2013.01)

(58) Field of Classification Search
CPC .... B66D 3/18; B66D 3/24; B66D 2700/0141; B66D 2700/0166; F21V 21/16; F21V 21/38; F21V 27/00
USPC ..... 254/278, 276
See application file for complete search history.

(56) References Cited

U.S. PATENT DOCUMENTS 2,942,879 A * 6/1960 Izenour ..... 472/78
3,066,253 A * 11/1962 Bowers ..... G01B 7/046 324/206
3,517,830 A * 6/1970 Virkkala ..... 212/275
3,566,478 A * 3/1971 Hurlston ..... G01B 21/06 324/206
3,610,584 A * 10/1971 Pfaff, Jr. ..... 362/403
3,680,836 A * 8/1972 Amelotte ..... B60S 9/08 254/426
3,753,294 A * 8/1973 Attali et al. ..... 33/735
3,759,489 A * 9/1973 Jones ..... E21B 19/08 173/6
3,822,834 A * 7/1974 Fjarlie ..... H02G 11/02 242/386
4,177,973 A * 12/1979 Miller et al. ..... 254/276
4,187,681 A * 2/1980 Johnson ..... 60/395
4,372,535 A * 2/1983 Gibson et al. ..... 254/319
4,436,190 A * 3/1984 Wentzell ..... B65H 75/4449 191/12.2 R
4,475,163 A * 10/1984 Chandler et al. ..... 702/163
4,513,952 A * 4/1985 Vandelinde ..... 254/285
4,597,183 A * 7/1986 Broding ..... G01S 13/88 324/206
4,616,321 A * 10/1986 Chan ..... E21B 45/00 702/9
4,662,628 A * 5/1987 Chatenay epouse Compagnone ..... 472/77
4,717,029 A * 1/1988 Yasunobu et al. ..... 212/275
4,718,168 A * 1/1988 Kerr ..... 33/735
4,804,095 A * 2/1989 Rohr et al. ..... 37/308
5,062,048 A * 10/1991 Coulter et al. ..... 702/6
5,105,349 A * 4/1992 Falls et al. ..... 362/405
5,127,533 A * 7/1992 Virkkunen ..... 212/275
5,155,922 A * 10/1992 Cooper ..... B66B 7/06 33/735
5,342,020 A * 8/1994 Stone ..... 254/269
5,351,531 A * 10/1994 Kerr ..... 73/152.54
5,420,772 A * 5/1995 Evans ..... 362/386
5,546,672 A * 8/1996 Campbell et al. ..... 33/716
5,556,195 A * 9/1996 Glebe ..... 362/386
5,570,546 A * 11/1996 Butterworth et al. ..... 52/111
5,645,181 A * 7/1997 Ichiba et al. ..... 212/281
5,720,345 A * 2/1998 Price et al. ..... 166/254.2
5,758,867 A * 6/1998 Arnesson ..... 254/103
5,762,282 A * 6/1998 Wolner ..... 242/390.8
5,818,185 A * 10/1998 Freitag et al. ..... 318/432
6,003,843 A * 12/1999 Fujiwara et al. ..... 254/271
6,216,789 B1 * 4/2001 Lorsignol ..... B66D 1/505 166/355
6,333,699 B1 * 12/2001 Zierolf ..... 340/854.8
6,345,724 B1 * 2/2002 Masumoto et al. ..... 212/173
6,390,012 B1 * 5/2002 Watt et al. ..... 114/322
6,520,484 B1 * 2/2003 Shimizu et al. ..... 254/276
6,520,485 B1 * 2/2003 Soot ..... 254/331
6,563,303 B1 * 5/2003 Watkins ..... 324/206
6,644,629 B1 * 11/2003 Higashi et al. ..... 254/361
7,004,456 B2 * 2/2006 Newman ..... 254/323
7,063,306 B2 * 6/2006 Sanders et al. ..... 254/361
7,080,825 B1 * 7/2006 George et al. ..... 254/267
7,153,001 B2 * 12/2006 Kim ..... 362/291
7,192,010 B2 * 3/2007 Roodenburg et al. ..... 254/360
7,243,870 B2 * 7/2007 Pook et al. ..... 242/278
7,270,312 B1 * 9/2007 Phipps ..... B66D 1/22 254/278
7,293,762 B2 * 11/2007 Hoffend, Jr. ..... 254/394
7,389,972 B2 * 6/2008 Mathias ..... 254/275
7,416,169 B2 * 8/2008 Noeske et al. ..... 254/275
7,480,534 B2 * 1/2009 Bray ..... H05B 37/0227 700/19
7,484,712 B2 * 2/2009 Hossler ..... 254/331
7,866,630 B2 * 1/2011 Ueki et al. ..... 254/274
7,896,315 B2 * 3/2011 Faust ..... 254/275
8,348,215 B1 * 1/2013 Smith ..... 248/329
8,412,359 B2 * 4/2013 Boleko Ribas ..... H05B 37/02 700/11
8,439,109 B2 * 5/2013 Sbordone ..... 166/250.01
8,596,616 B1 * 12/2013 Soot ..... 254/394
8,627,575 B2 * 1/2014 Tang et al. ..... 33/333
8,651,301 B2 * 2/2014 Kiova et al. ..... 212/284
8,657,134 B2 * 2/2014 Morath ..... 212/281
8,905,380 B2 * 12/2014 Davis ..... 254/273
2001/0045549 A1 * 11/2001 Johnson ..... 254/267
2005/0072965 A1 * 4/2005 Sanders et al. ..... 254/361
2006/0047430 A1 * 3/2006 Edwards ..... G01V 9/00 702/6
2006/0163547 A1 * 7/2006 Jackson et al. ..... 254/276
2006/0240933 A1 * 10/2006 Shan ..... B66D 1/22 475/204
2006/0284151 A1 * 12/2006 Hossler ..... 254/278
2009/0242861 A1 * 10/2009 Kochan et al. ..... 254/293
2010/0206831 A1 * 8/2010 Faust ..... 212/278
2010/0308289 A1 * 12/2010 Dalsmo et al. ..... 254/270
2011/0089388 A1 * 4/2011 Kiova et al. ..... 254/267
2013/0112643 A1 * 5/2013 Lecours et al. ..... 212/276
2013/0112930 A1 * 5/2013 Davis ..... 254/264
2013/0129452 A1 * 5/2013 Vehmeijer et al. ..... 414/141.7
2013/0251496 A1 * 9/2013 Takesue et al. ..... 414/800
2014/0107971 A1 * 4/2014 Engedal et al. ..... 702/150
2014/0166953 A1 * 6/2014 Wright et al. ..... 254/270
2014/0348593 A1 * 11/2014 Kawahara et al. ..... 405/224
2015/0083985 A1 * 3/2015 Lervik ..... B63B 21/22 254/340

FOREIGN PATENT DOCUMENTS

JP 2004-6208 A * 1/2004 ..... F21V 21/36
JP 2004006208 A 1/2004
JP 2007284174 A 11/2007
WO 9952648 A1 10/1999
WO WO 9952648 A1 * 10/1999 ..... B05D 1/36

OTHER PUBLICATIONS

Communicaiton of a Notice of Opposition dated Apr. 16, 2014, Application No. 10195881.7-1705 / 2466252, Applicant Christopher Bauder, 21 Pages.

* cited by examiner

WINCH FOR PROVIDING A PART OF UNWOUND CABLE WITH A PREDETERMINED LENGTH

CROSS-REFERENCE TO RELATED APPLICATIONS

This application is a U.S. national phase of PCT Application No. PCT/EP2011/072911 filed Dec. 15, 2011, which claims priority to European Application No. 10195881.7 filed Dec. 20, 2010, the disclosures of which are incorporated in their entirety by reference herein.

TECHNICAL FIELD

This invention is directed to a winch which is configured to provide a predetermined length of unwound cable, where an electric device can be connected to the cable. Such a winch may be used, in particular, to provide an eye catcher in some kind of display, for example to attract attention of people in the environment of a trade fair, or to direct public attention to a show window. Other possibilities for employing a winch according to the invention may be forming, or being integrated into, a work of art. Locations where such a winch is installed may be a hall, a lobby or a staircase of a building. Such a building may be part of a museum, an airport or a hall for arranging events. In general, a winch according to the invention may be employed for arrangements in an interior space, in particular in a wide interior space.

BACKGROUND

Conventional winches may be installed on a ceiling, and may be used to move some kind of electric device, for example a light source, such that an electric device connected to the cable hangs down from the ceiling with a predetermined distance from the ceiling. In the prior art, such a winch is driven by an electric motor, and is controlled by switching electric power on for moving the winch, and switching electric power off as soon as the object hangs down from the ceiling at the desired distance. The velocity by which the object is moved up and down is given by the speed of an electric motor in the winch at a voltage which is provided to the winch. However, in a winch hanging an electric device from the ceiling by a cable, the cable carrying the object is usually wound around a cable roll to move the electric device up or down. Taking into account that the diameter of the cable which is wound-up around the cable roll decreases as more cable is unwound from the roll, the linear velocity by which the electric device is moved downward also depends on the amount of cable which is coiled on the cable roll, with the effect that the velocity by which the object is moved downward by a conventional winch is not constant even if the cable roll of the winch is driven with a constant voltage, resulting in a constant number of rotations per time.

Hence, the motion of an electric device connected to the cable of a conventional winch cannot be controlled precisely with respect to velocity and/or acceleration of the connected electric device. This is a particular disadvantage in the case where a plurality of electric devices, for example, lamps, have to be moved simultaneously with a particular relationship between their locations so as to form some kind of predetermined spatial pattern.

Therefore, there is a need for a winch which offers a better control of the motion of an electric device connected to its cable while the cable is unwound up to a predetermined length.

SUMMARY

To satisfy this need, the invention provides a winch according to claim 1 and a system according to claim 13. In particular, the invention provides a winch, comprising: a cable roll, configured to wind and unwind a cable, a cable, wherein one end of the cable is fixed to the cable roll, and wherein its other end is configured to electrically connect an electric device to the cable and wherein the cable is further configured to provide the electric device with electric power and/or with data, a framework to which the cable roll is mounted, measuring means connected to the framework and configured to provide data related to the length of the unwound part of the cable, and processing means configured to control winding and unwinding of the cable, based on the data provided by the measuring means, wherein there is a predetermined fixed reference point on the cable, and there is a predetermined reference state of the cable, at which the predetermined fixed reference point is at a reference position in relation to a coordinate system, and wherein the length of unwound cable is defined as the distance, measured along the cable, between the location of the predetermined fixed reference point and the reference position.

In the winch according to the invention, the cable is wound around a cable roll, and a measuring means is provided which is configured to provide data related to the length of the unwound part of the cable to processing means. The processing means then uses these data to control the winding of the cable. In this way, the length of the unwound part of the cable at a given time can be determined by the processing means as well as a velocity and an acceleration of the unwound part of the cable during winding or unwinding. So, a winch according to the invention has the possibility to compensate distracting effects on the motion inferred by mechanical influences, for example, a change of linear velocity of an object in dependence on the amount of unwound cable. In other words, the winch according to the invention permits moving a cable in a more precise way.

The cable may also be configured to mechanically attach the electrically connected electric device.

The end of the cable which is configured to electrically connect an electric device to the cable may be a tip of the cable, or may be an end portion of the cable. The cable may be configured to electrically connect an electric device to a location at the end portion of the cable. The end portion may comprise a distance of 4 meter from the tip of the cable, in particular, 10 centimeters, 50 centimeters, 100 centimeters or 150 centimeters or 200 centimeters. The total length of the cable may be 20 meter, in particular, 10 meter, or 8 meter.

The predetermined reference state may refer to a particular spatial configuration of the cable. The predetermined reference state may describe a particular way of how the cable is oriented in space. The predetermined reference state may describe a reference positioning of the cable. The predetermined reference state may be the result of arranging the cable in a particular way.

The predetermined fixed reference point on the cable may be in an end portion of the cable. The reference position may be a position inside the framework of the winch. The framework of the winch may have an opening where the cable is lead from the inside of the framework to the outside of the framework. The reference position may be in the center of this opening.

A location of the predetermined fixed reference position and the reference location may be determined with respect to the same coordinate system. That coordinate system may be fixed to the framework of the winch. The coordinate system may have its origin at a particular point at the framework of the winch. The coordinate system may also be centered at the axis of the cable roll. The coordinate system may be used for determining the location of the predetermined fixed reference position and of the reference location. The predetermined reference state may also be specified in that same coordinate system.

The cable may be in the reference state reference state if the predetermined fixed reference point has the same position as the reference position.

The measuring means may be configured to provide the length of the unwound part of the cable.

The cable may be a reinforced signal cable with a rectangular cross section.

The corners of the cable may be rounded down. Because of its rectangular cross section, the cable may be wound or unwound more precisely, as velocity and positioning of cable portions which are wound into the cable roll can be controlled more exactly than in the case of a cable without rectangular cross section. In particular, portions of the cable which are wound such that they are on top of each other in the coil of wound cable may lie flush on top of each other. Hence, the radius of a coil of wound cable can be controlled more exactly than in the case where a round cable would be used. If the breadth of the cross section of a rectangular cable corresponds to the distance between flanks on the cable roll, the cable may be wound even more precisely as the cable is guided straight into the cable roll without having a possibility of forming zigzag portions when wound into the roll. In this way, the amount of wound cable as well as the velocity of winding can be controlled more precisely by using a cable with rectangular cross section.

An electric device may be pinned to the cable. The cable may be configured to carry the weight of an electric device which is electrically connected to the cable.

The cable may be a flat signal cable. The cable may comprise a sheathing with a channel in its inside. The cable, in particular, the sheathing, may have a rectangular cross section. The corners of the sheathing may be rounded down. The cable may be configured to provide an attached electric device with electric power and/or data using at least one connector which is comprised in the channel inside its sheathing. The cable may be reinforced to permit a high load. The cable may comprise a reinforcing thread which may be made of non-stretchable material so as to prevent an extension of the cable if a high weight is attached to the cable. In particular, an aramide yarn may be integrated into the sheathing of the cable. Alternatively or in addition, an aramide yarn may be integrated in the center of the cable inside the sheathing. The at least one connector in a sheathing of the cable may comprise an electrically conducting wire and/or a glass fiber cable. The cable may comprise power supply and multiple signal lines for realtime control of an electric device attached to the cable.

The cable roll may be attached to the framework. The cable roll may have a slip ring in its center. The slip ring may be used to lead electric current from a wiring attached to the framework of a winch into the cable, in particular, to at least one of the connectors inside the sheathing of the cable. The cable may comprise 20 wires which are electrically connected to the slip ring, in particular, 10 wires, 6 wires or 3 wires. The wires may be lead out of the slip ring into the cable roll. The wires inside the sheathing of the cable may be led from an end point of the sheathing into a socket. The socket may be embedded into a side portion of the cable roll. The socket may be configured to be connected to a plug which is attached to the end of cables which are led out of the movable part of the slip ring. A side portion of the cable roll may have an opening where a plug may be sunk in the side portion. The opening in the side portion of the cable roll may be centered on the axis of the cable roll.

The slip ring may be electrically connected to the processing means. In particular, data and/or electric power may be forwarded from the processing means to the slip ring. The data and/or electric power may then be lead from the slip ring into at least one of the wires, in particular, 6 wires, inside the cable.

A winch, in particular, the framework of a winch may be made from black anodized aluminium parts. A winch may further comprise a solid protective shell.

A winch may further comprise an electric motor, which is configured to set the cable roll into rotation, and wherein the processing means is configured to control the electric motor.

A gear may be used adapt a driving speed of the electric motor to a desired angular velocity of the cable roll.

The winch may be configured to lift a load of at least 1 kilogram and up to more than 100 kilogram, preferably of at least 2 kilogram and up to more than 90 kilogram, preferably of at least 3 kilogram and up to more than 80 kilogram, preferably of at least 4 kilogram and up to more than 70 kilogram, preferably at least 5 kilogram and up to more than 60 kilogram. The cable of a winch may be reinforced so as to permit lifting such loads. The electric motor of the cable roll may be adapted to lift such loads.

The processing means may provide control signals to the electric motor, or may provide the electric motor with a current driving the electric motor. The processing means may control up to 100 parameters, in particular, 50 parameters, 30 parameters or 15 parameters. Particular parameters which may be controlled by the processing means may be at least one of: value of the position of the cable roll, value of the position of the cable roll with high precision, control of a red LED in an electric device electrically connected to the cable, control of a green LED in an electric device connected to the cable, control of a blue LED in an electric device connected to the cable, control of a white LED in an electric device connected to the cable, operation mode of the winch, in particular, adjustment mode or performance mode, winding the unwound part of the cable to a minimum value, unwinding the unwound part of the cable to a maximum value, the voltage and/or current for a light emitting device which is electrically connected to the cable, voltage and/or current for an electric motor to drive the winch. At least one of the parameters may be associated with a channel in a communication according to the DMX protocol.

The processing means may comprise a microprocessor. Software carried out by the microprocessor may be stored in a read-only-memory, or may be stored in random access memory. which is comprised in the winch The software which is to be carried out by the microprocessor may be specified by the user. In particular, the winch may comprise dip switches to specify the software to be executed by the microprocessor.

The processing means may also comprise hardware for signal distribution, in particular, hardware for digital signal distribution. The processing means may comprise a software interface. The software interface and the hardware for signal distribution may be interconnecting components. The processing means may be configured to provide realtime control over the electric motor. Alternatively or in addition, the processing means may provide realtime control over an electric device which is electrically connected to the cable of a winch, in particular, over a light emitting device. Electric devices which are electrically connected to the cable may be at least one of a light emitting device, a motor, a relais, a sensor, a loudspeaker. There may be two or more electric devices be electrically connected to the cable, for example, a light emitting device and a sensor.

The processing means may comprise a storage with light control software which enables the processing means to control an electric device electrically connected to the cable of a winch, in particular, a light emitting device. Alternatively or in addition, the processing means may comprise a storage with movement control software which enables the processing means to control the movement of the cable roll. The light control and/or the movement control software may be scalable. In particular, the light control software and/or the movement control software may be designed to be carried out by a plurality of microprocessors simultaneously, and/or may control a plurality of devices. The light control and/or movement control software to be carried out may be selected using dip switches comprised in the winch.

A gear may be used to adapt the rotational speed of the electric motor to a desired rotational speed of the cable roll. Alternatively or in addition, a gear may be used to change the rotational direction of the cable roll while the electric motor does not change its rotational direction.

The measuring means may be configured to provide data related to the length of the unwound part of the cable based on the amount of cable which is wound around the cable roll.

In particular, the measuring means may be configured to provide the length of the unwound part of the cable.

The measuring means may comprise an encoder which is configured to provide data related to an angle by which the cable roll has rotated, with respect to the position of the cable roll corresponding to the reference state of the cable, and/or an angle which indicates the position of the cable roll.

In particular, the encoder may provide the angle by which the cable roll has rotated, and/or the angle which indicates the position of the cable roll. The position of the cable roll may be its angular position. The encoder may be mechanically connected to the electric motor configured to set the cable roll into rotation, as mentioned above. The encoder may provide an angle by which the cable roll has rotated. The encoder may provide an angle which is the position of the cable roll with respect to the position of the cable roll corresponding to the reference state of the cable. The encoder may provide a signal each time when the cable roll has rotated by a particular angle. The particular angle may be 20 degrees, in particular, 10 degrees, 7 degrees, 3 degrees or 1 degree.

The measuring means may comprise a measuring controller and/or length tracking means. The measuring means may be configured to determine the amount of cable which is wound around the cable roll by monitoring the motion of the cable roll. The measuring means may be configured to monitor the motion of the cable roll beginning with a predetermined starting position of the cable roll. The length tracking means may provide information about the rotational motion of the cable roll. The length tracking means may comprise the encoder mentioned above.

The processing means may be connected to the measuring controller. The processing means, in particular may be configured to carry out all or part of the functionality of the measuring controller. In particular, the processing means may comprise the measuring controller. The measuring controller may receive data from the length tracking means indicating the number of rotations which the cable roll has been performed, beginning with a predetermined starting position. Alternatively and/or in addition, the length tracking means may also provide data to the measuring controller about the radius of the coil formed by that part of the cable which is still wound around the cable roll. Based on this data, the measuring controller may keep track of the length of that part of the cable which is wound around the cable roll. The measuring controller may be configured to determine the length of a part of the cable which is wound to or unwound from the cable roll during a time interval.

The processing means may receive data from the measuring means specifying the radius of the coil formed by that part of the cable which is wound around the cable roll.

The processing means may be configured to control the angular velocity of the cable roll, by taking into account data related to the length of the unwound part of the cable, and causing the predetermined fixed reference point on the cable to move with a predetermined linear velocity and/or acceleration, in particular, with a constant linear velocity and/or acceleration, while the cable is wound or unwound.

The processing means may be configured to control the angular velocity of the cable roll based on the product of the angular velocity of the cable roll and the radius of the coil formed by that part of the cable which is wound around the cable roll. In particular, the processing means may be configured to control the angular velocity of the cable roll such that the product of the angular velocity of the cable roll and the radius of the coil formed by that part of the cable which is wound around the cable is kept at a constant value.

The processing means may be configured to drive the cable roll with a predetermined angular velocity, in particular, with a constant angular velocity. The processing means may be configured to drive the cable roll with an angular velocity above a predetermined lower angular velocity and below a predetermined upper angular velocity. The processing means may be configured to control the acceleration of the angular velocity of the cable roll, in particular, to maintain a predetermined value of the angular velocity.

The winch may further comprise a magnet which is attached to the cable and a magnet sensor which is be configured to be sensible to the magnetic field of the magnet.

The magnet may be attached to the cable at a location on the cable with a predetermined relation to the predetermined reference point. In particular, the magnet may be attached to the cable at the predetermined fixed reference point. The predetermined fixed reference point may be at the reference position if the magnet is sensed by the magnet sensor. The cable may be in the reference state if the magnet is sensed by the magnet sensor. The reference position may be that point where the magnet sensor senses the magnet. The magnet sensor may be part of the measuring means.

The processing means may be configured to define a starting position of the cable roll. The processing means may be configured to define a starting position of the cable roll if the magnet sensor senses the magnet. The processing means may be configured to define the starting position of the cable roll. The processing means may be configured to wind the cable roll such that the cable is in its reference state.

The measuring means may be configured to provide data to the processing means which are based on the output of the magnet sensor and specify at least one of: whether the magnet is sensed by the magnet sensor, the length of the part of the cable which has been unwound from the cable roll, the rotational speed of the cable roll, the radius of the coil formed by that part of the cable which is still wound around the cable roll. The processing means may be configured to stop winding or unwinding the cable roll based on data received from the measuring means, in particular based on data measured by the magnet sensor. The processing means may be configured to stop the rotation of the cable roll, for example, by sending a corresponding instruction to an electric motor driving the cable roll, if the processing means receives data from the measuring means specifying that the magnet mentioned above is sensed by the magnetic sensor mentioned above. The magnet sensor may be a Hall sensor, or a reed sensor.

The processing means may be configured to provide an auto setup function performed to bring the cable into the reference state.

The processing means may be configured to perform the auto setup function by letting the cable roll wind and/or unwind and letting the cable roll stop if the magnet attached to the cable is sensed by the magnet sensor attached to the framework of the winch. If the magnet sensor is a Hall sensor, the auto setup function may work with Hall sensor end position detection. When performing the auto setup function, the processing means may set the starting position of the cable roll. Alternatively, then performing the auto setup function, the processing means may wind the cable such that the cable is in its reference state.

The processing means may be configured to issue data, in particular, instructions, and forward the data to the cable.

The instructions issued by the processing means of a winch may be directed to an electric device electrically connected to the cable of the winch.

In this way, the electric device is provided with power and/or data by the cable.

The length tracking means mentioned above may be connected to the cable roll by a gear mechanism. The gear transmission ratio of the gear mechanism may be between 1 to 5 and 1 to 20, in particular, may be 1 to 10. The length tracking means may measure an angle by which the cable roll has rotated. The length tracking means may be a potentiometer.

The winch may further comprise an electric device which may be pinned on the cable, in particular, a light emitting device, a sound emitting device, a sensor, an actuator or a motor.

The cable may carry the weight of the electric device which is pinned on the cable. The electric device may be pinned on the cable by means of a pull relief which is attached to the cable.

An electric device comprising an interactivity sensor may be electrically connected to the cable. The cable may be configured to forward signals from the interactivity sensor to the processing means. In this way, the cable of a winch can be moved in response to signals sensed by the activity sensor. In this way, interaction winch a winch is possible by influencing an activity sensor comprised in an electric device electrically connected to the cable of a winch.

The processing means may be configured to send data, in particular, instructions, to the electric device using the cable.

The processing means may coordinate changes of the electric device, in particular, of a light source, which is electrically connected the cable, with the motion of the winch.

The winch may further comprise a plug, which is attached to an end portion of the cable, wherein the plug is configured to be plugged to an electric device to provide an electrical connection to the cable. The winch may further comprise a pull relief, which is attached to the cable, and which is configured such that an electric device may be pinned on it. The plug may be connected to at least one wire inside the sheathing of the cable of a winch. The pull relief may be attached to the cable at a location on the cable which has a predetermined relationship with the location of the pull relief, in particular, is near the pull relief. In this way, it is possible to pin an electrical device mechanically on the pull relief and electrically to the plug. The pull relief and/or the plug may be attached to the cable at a location which has a predetermined relationship to the location of the above-mentioned magnet. The magnet may be attached to the cable at a location on a part of the cable which is not configured to be wound up on the cable roll.

The winch may be configured to be mounted on a ceiling and/or to be attached to, in particular, to be hanged down from, a truss or a framework, and/or to be attached to a floor. Alternatively or in addition, the winch may be configured to be mounted on a floor. The direction of the motion of the cable when the cable is wound or unwound may be based on the direction of the gravitational force at the location of the electric device, in particular, may point to the direction of the gravitational force or in the direction opposite to the gravitational force at the location of the electric device. In particular, the direction of motion may point perpendicularly downward or upward.

An electric device electrically connected to the cable of a winch may have a type from a set of types comprising at least one of: a light emitting device, a sound emitting device, a sensor, an actuator, a motor or other controllable electric consumers. The electric device may be a light emitting device, and the light emitting device may comprise at least one Light Emitting Diode, LED. The least one LED may be a super bright LED. The LEDs may comprise at least one LED emitting red light, at least one LED emitting green light, and at least one LED emitting blue light. Alternatively or in addition, the LEDs may comprise at least one LED emitting white light, in particular, bright white light. In particular, a light emitting device may provide full color RGB output, or RGB plus white (RGBW) output. The light emitting device may comprise a purpose-fitted custom light source. The light emitting device may have a casing with a preconfigured form. In particular, the casing of the light emitting device may have the form of a sphere, a pole, or may have a free form, in particular, an irregular form. The light emitting device may comprise LEDs arranged in clusters and/or may comprise LEDs arranged in strips and/or may comprise LEDs arranged in any other way.

The winch may further comprise an interface configured to receive data and/or electric power from an external controller.

By receiving data and/or electric power from an external controller using the interface, the winch can provide an electrically connected electric device with electric power and/or with data. Instead or in addition, the interface may be configured to permit communication from the winch to an external controller using the interface. The interface may permit wired communication, and/or may permit wireless communication with the winch.

The external controller may be a computer, a smartphone or a mixing desk. The external controller may be a PC with custom control software. The custom control software may be flexible so as to allow special customization purposes.

The interface may be associated with an address identifying the winch. The interface of a winch may be configured to be individually addressable. Configuration of an address of the interface may be performed using dials comprised in the winch which are adjustable by a user. The data forwarded to the interface from the outside of the winch may comprise the address of the winch, and/or the interface may be configured to accept only a particular segment of data, which is associated with the address of the winch, out of a data stream detected at the interface.

The interface may be connected to the processing means. Alternatively or in addition, the interface may be connected to the cable, in particular to at least one connector inside a sheathing of the cable. The connection between the interface and the cable may be accomplished using the above-mentioned slip ring in the center of the cable roll. The interface may be configured to permit exchange of digital data and/or analog data. The interface may be configured to provide communication using DMX data. The interface may be configured to transfer DMX data using the ArtNet protocol. The interface may be configured to transfer data using a LAN protocol, in particular, an Ethernet protocol. The interface may also be configured for serial data exchange, in particular, to exchange data according to the RS-232 standard.

The processing means may be configured to receive data, in particular, instructions, from the external controller using the interface.

The instructions received by the processing means may refer to a required length of the currently unwound part of the cable and/or may refer to a required velocity and/or a required acceleration to be applied to the electric object by driving the cable roll.

An electric device may be electrically connected to the cable, and the cable may be configured to forward instructions to the electrically connected electric device, wherein the instructions may be provided by the external controller using the interface. Alternatively or in addition, the instructions may be issued by the processing means.

The electric device may comprise processing means, in particular, a microprocessor. The processing means in the electric device may control light emission by at least one light source comprised in the electric device. The at least one light source may comprise at least one LED. The at least one LED may emit colored light, in particular, a color of red, green or blue, or may emit white light. The processing means may control light emission by at least one LED in such a way that the effect of one or more moving light sources is achieved.

An electrical device comprising an interactivity sensor may be electrically connected to the cable, wherein the interactivity sensor may be configured to forward data, in particular, instructions, to the cable.

The interactivity sensor may be configured to forward data and/or instructions in response to an event detected by the interactivity sensor. The cable may be configured to forward signals from the interactivity sensor to the interface. The processing means may be configured to receive data and/or instructions forwarded from the interactivity sensor. In response to data and/or instructions forwarded from the interactivity sensor, the processing means may be configured to issue instructions and/or data to the electric device and/or to cause the cable roll to wind or unwind.

The invention further provides a system comprising: a plurality of winches according to the invention as described above, and a system controller, configured to issue instructions to be executed by a winch to at least one of the plurality of winches, and/or to provide data, in particular, instructions to be executed by an electric device, and/or electric power, to at least one electric device, wherein the at least one electric device is electrically connected to the cable of a winch from the plurality of winches.

In this way, it becomes possible to control the position and the motion of electric devices, like lamps, which are electrically connected to the cables of winches, in a more precise way. Consequently, this system permits moving and positioning the electric objects such that they precisely form a predetermined spatial pattern.

The at least one electric device may also be mechanically attached to the cable of a winch from the plurality of winches.

The system controller may be a single controller. The system controller may be located outside of the winches. The system controller may be configured to issue instructions to each of the plurality of winches. The system controller may comprise control software. The system controller may be a computer, a smartphone, or a mixing desk. A connection between the system controller and at least one of the at least one winches may be a wire-based and/or a wireless connection.

The system controller may comprise two interconnecting components. In particular, the system controller may comprise a software interface and hardware for digital signal distribution. The system controller may comprise software for controlling the movement of the cable of at least one of the plurality of winches. The software run by the system controller may be scalable to the number of winches in the plurality of winches.

The plurality of winches may be winches which further comprise an interface configured to permit communication from an external controller using the interface to the winch, as described above.

The processing means may be configured to receive data, in particular, instructions, from the external controller using the interface.

The system controller of the system may be an external controller where the processing means may be configured to receive data, in particular, instructions, from, as mentioned above.

The data which may be received by the interface of the at least one of the plurality of winches may comprise instructions. The instructions may comprise instructions which are directed to the at least one winch, in particular, to the measuring means in the at least one winch. Alternatively or in addition, the instructions may comprise instructions which are directed to an electric device which is electrically connected to the cable of the at least one winch.

The system may further comprise data connection means, wherein the system controller may be configured to use the data connection means to select at least one of the plurality of winches for communication and to issue instructions to the at least one selected winch.

The data connection means may be a network. The network may connect at least one of the plurality of winches with the system controller. The network may connect at least two of the plurality of winches with each other and the system controller. The system controller may be configured to communicate to the plurality of winches using the network. The network may be a wired and/or wireless network, and the network members may be connected by means of electric cables and/or glass fiber cables and/or by wireless communication. The network may be a bus system. The network may have a star-like topology or a ring topology. Alternatively, or in addition, the system controller may be configured to communicate to an individual one of the plurality of winches using a point-to-point connection between the system controller and the individual one of the plurality of winches.

The system controller may be configured to select at least one of the plurality of winches to communicate individually with the at least one of the plurality of winches and/or is configured to select at least one group of the plurality of winches to communicate simultaneously with each member of the group. The system controller may be configured to provide instructions to one individual winch or to a group of winches simultaneously. In the case of a group of winches, The instructions may be directed moving the cable of the addressed winches, and/or may be directed to devices electrically connected to the cables of the addressed winches.

The system controller may be configured to provide a required length of an unwound cable and/or a required speed and/or a required acceleration to one single winch or to a group of winches simultaneously. The system controller may be configured to issue an instruction which instructs one single winch or each of a group of winches to perform unwinding the required length of cable and/or to perform providing the cable with the required speed and/or with the required acceleration simultaneously. The system controller may address each one of the plurality of winches individually.

The system controller may be configured to provide one or more of the required lengths of unwound cable and/or the required speed and/or the required acceleration based on predetermined data stored on and/or input to the system controller. Alternatively or in addition, the central processor may be configured to provide one or more of the required length of an unwound cable and/or the required speed and/or the required acceleration based on data computed by the system controller within a predetermined time interval immediately before issuing an instruction to the at least one winch based on the computed data.

The system controller may be configured to issue instructions based on random data and/or based on predetermined data. The system controller may be configured to issue instructions to a winch or a plurality of winches which vary over time in a predetermined way.

The system controller may have stored, for at least one of a plurality of winches, a length value specifying a length of cable which has to be unwound by at least one of the plurality of winches. For at least one winch of a plurality of winches, the controller may issue an instruction comprising a length value and/or a velocity and/or an acceleration to the at least one winch such that the devices, in particular, light emitting devices, each of which is electrically connected to the cable of one of the at least one of the plurality of winches, form a spatial pattern. The length value and/or the velocity and or the acceleration specified in the instruction to the at least one winch may be based the value of a function of at least one variable. The at least one variable may correspond to at least one coordinate of a mounting position of the at least one winch. In particular, the at least one variable may be two variables indicating the mounting position of at least one winch on a surface, for example, on a ceiling. The at least one variable may also be a single variable indicating the position of the at least one winch along a one-dimensional curve, in particular, along a pole, or a along a curved object for mounting at least one winch.

Each of the plurality of winches may be fastened to a ceiling and/or to a floor at a predetermined location. Alternatively or in addition, each of the plurality of winches may be attached to a truss or to a mounting framework. The winches may be fastened and/or attached in a special grid configuration, or may be positioned in loose positioning.

For each of the plurality of winches, a length value of unwound cable may be derived, by the system controller, from the value of a function having, as input, the predetermined location of the winch at the ceiling and/or the floor. By controlling that each of the winches unwinds its cable by a length based on the length value derived for that winch, the system controller may control the winches such that the electric devices electrically connected to the cables of the winches form a spatial pattern which corresponds to a graph of the function. The system controller may successively issue instructions comprising length values to a particular winch where the length values specified in the instructions vary. In particular, the system controller may provide realtime control over the cable movement of at least one of the plurality of winches and/or over an electric device electrically connected to the cable of the at least one winch. In particular, the system controller may provide realtime control over the cable movement of each of the plurality of winches as well as over an electric device electrically connected to the cable of each of the plurality of winches.

An electric device may be electrically connected to the cable of at least one winch of the plurality winches, and the system controller may be configured to select the at least one of the plurality of winches for communication and to issue instructions to the electric device electrically connected to the cable of the at least one winch.

The type of the electric device may comprise at least one of a light emitting device, a sound emitting device, a sensor, an actuator or a motor. The instructions may be forwarded to the electric device electrically connected to the cable of a winch. The instructions forwarded to the electric device using the cable of a winch may comprise instructions which are provided by the system controller using the interface of the winch. Successive instructions issued by the system controller to a particular winch may be varied over time in a predetermined way. The instructions forwarded to the electric device may be based on random data and/or may be based on predetermined data and/or may be based on data input by the user and/or may be based on data provided by a sensor in the electric device. Alternatively or in addition, instructions which are provided by the processing means of the winch may be forwarded to a electric device electrically connected to the cable.

The electric device may generate an output signal, like from a light sensitive device and/or a microphone. The electric device may be electrically connected to the cable of at least one of the winches. The output signals from the electric device may be transmitted, using the wires in the sheathing of the cable, to the system controller. The system controller may be configured to issue instructions to a winch and/or to issue instructions to an electric device, in particular, to a light emitting device, electrically connected to the cable of a winch, in response to the output signal of the electric device electrically connected to the cable of a winch.

The instructions to the electric device may comprise at least one of: switching on or off of a light, changing brightness and/or color of a light, changing intensity and/or tone pitch of a sound, switching on or off of a microphone, tightening or loosening the grip of an actuator, accelerating or decelerating of a motor.

The system controller may cause electric devices which are light emitting devices to change the brightness of the emitted light. The light emitting devices may comprise light sources with different colors. The system controller may cause a light source to change its color and/or to change its brightness. The external controller may coordinate changes in a light source electrically connected to the cable of a winch with the motion of the winch. Alternatively or in addition, electrical devices may comprise sound sources. In particular, the electrical devices may comprise light sources and sound sources. The external controller may control the light sources and/or sound sources to change emitted light and/or emitted sound in coordination with the motion of the winches.

The system controller may cause devices electrically connected to different winches to be moved in a similar or identical way. The similar or identical motion of devices electrically connected to different winches may be deferred with respect to the similar or identical motion of another one of the devices so as to simulate a spatial progress of the motion of a device. A winch may wind/unwind its cable such that the electrically connected electric device moves with a linear speed which does not depend on the length of the cable which is unwound. Hence, the motion of a device may not depend on the distance between the involved electrical devices from the ceiling or from the ground.

The system controller may issue instructions to at least one of the electric devices electrically connected to the cables of the plurality of winches. The system controller may issue instructions to at least one of the electric devices which make the at least one electric device change its appearance, in particular, changing its brightness and/or color if the electric device is a light source. The system controller may be configured to provide a spatial pattern of light sources changing their position as well as color and/or brightness of the emitted light in a coordinated way.

A fluorescent tube, in particular, a light bar, may be electrically connected to the cable of at least one of the plurality of winches. The fluorescent tube may comprise at least one light source, in particular, at least one LED, or the fluorescent tube may emit light by employing a gas discharge mechanism. The fluorescent tube may be configured such that a point of light emission seems to move along the tube. The system controller may be configured to control light movement in a fluorescent tube electrically connected to the cable of at least one of the plurality of winches. Alternatively or in addition, the system controller may be configured to send instructions to more than one of a plurality of devices, in particular, fluorescent tubes, each of which being electrically connected to at least one of the plurality of winches. In particular, the system controller may be configured to control such more than one fluorescent tubes in a way that light movement may triggered along a line of the more than one fluorescent tubes. The fluorescent tubes may be light bars.

The cables of at least two of the plurality of winches may be electrically connected to the same electric device.

The cables of the at least two of the plurality of winches may also be mechanically attached to the same electric device. In this way, the at least two winches can carry and/or move a high weight. Alternatively or in addition, the at least two of the plurality of winches may be used in a coordinated way to control the motion of an electric device which is electrically connected to the at least two of the plurality of winches. In particular, the electric device may be moved in 3 dimensions by the at least two of the plurality of winches. The at least two of the plurality of winches may be, in particular, 3 or 4 winches. Alternatively or in addition, the electric device may be moved around more than two axes by the at least two of the plurality of winches. The system controller may communicate simultaneously with the at least two of the plurality of winches which are electrically connected to the same electric device. In this way, the system controller may accomplish moving an electric device in 3 dimensions and/or around more than two axes.

An electrical device may be connected to more than one of the plurality of winches. In particular, there may be a plurality of attachment points on the electrical device, each of which is electrically connected to the cable of one of a plurality of winches. On at least one of the attachment points, the electrical device may be plugged to wires inside the sheathing of the cable of one of the plurality of winches. The electrical device may be provided with electric power and/or with data, such as instructions, by means of the wires inside the sheathing of the cable of at least one of the electrically connected winches. Instructions to an electrically connected electrical device may be provided from the processing means comprised in at least one of the winches whose cables are electrically connected to one of the attachment points. Alternatively or in addition, instructions to the electrically connected electrical device may be provided from the system controller.

The system controller may issue instructions to at least one of the winches where the electric device connected to more than one winch is electrically connected to. The instructions may cause the at least one of the winches to wind or unwind its cable such that the attachment points of the electrical device are moved in a coordinated way. In this way, the system controller may cause the electric device, in particular, a large and/or heavy device, to be moved up and down by a plurality of winches simultaneously. Alternatively or in addition, the motion of the winches may be controlled by the system controller such that the electrical device is tilted and/or inclined and/or turned in a particular way by causing the winches winding or unwinding their cables with different speed and/or different acceleration. Alternatively or in addition, the motion of the winches may be controlled by the system controller such that the electrical device performs a rotational movement. In particular, motion of the winches may also be controlled by the system controller such that the electrical device performs a rotational movement by more than one axis, in particular, more than 2 axes. In this way, the electric device may perform a three-dimensional movement.

The electrical devices may be fluorescent tubes, in particular, linear fluorescent tubes or light bars. A fluorescent tube may be electrically connected at its ends to different ones from a plurality of winches. The external controller may be configured to shorten the unwound part of the cable at the one side of a fluorescent tube, and lengthen the part of unwound cable at the other side of the fluorescent tube. In this way, the system controller may be prepared to cause a rocking motion and/or a rotational movement of a fluorescent tube.

BRIEF DESCRIPTION OF THE DRAWINGS

Further aspects of the invention will be described below with reference to the attached figures

DETAILED DESCRIPTION

Exemplary embodiments of the invention are described in the following. However, the invention is not limited to the described examples.

Figure 1:
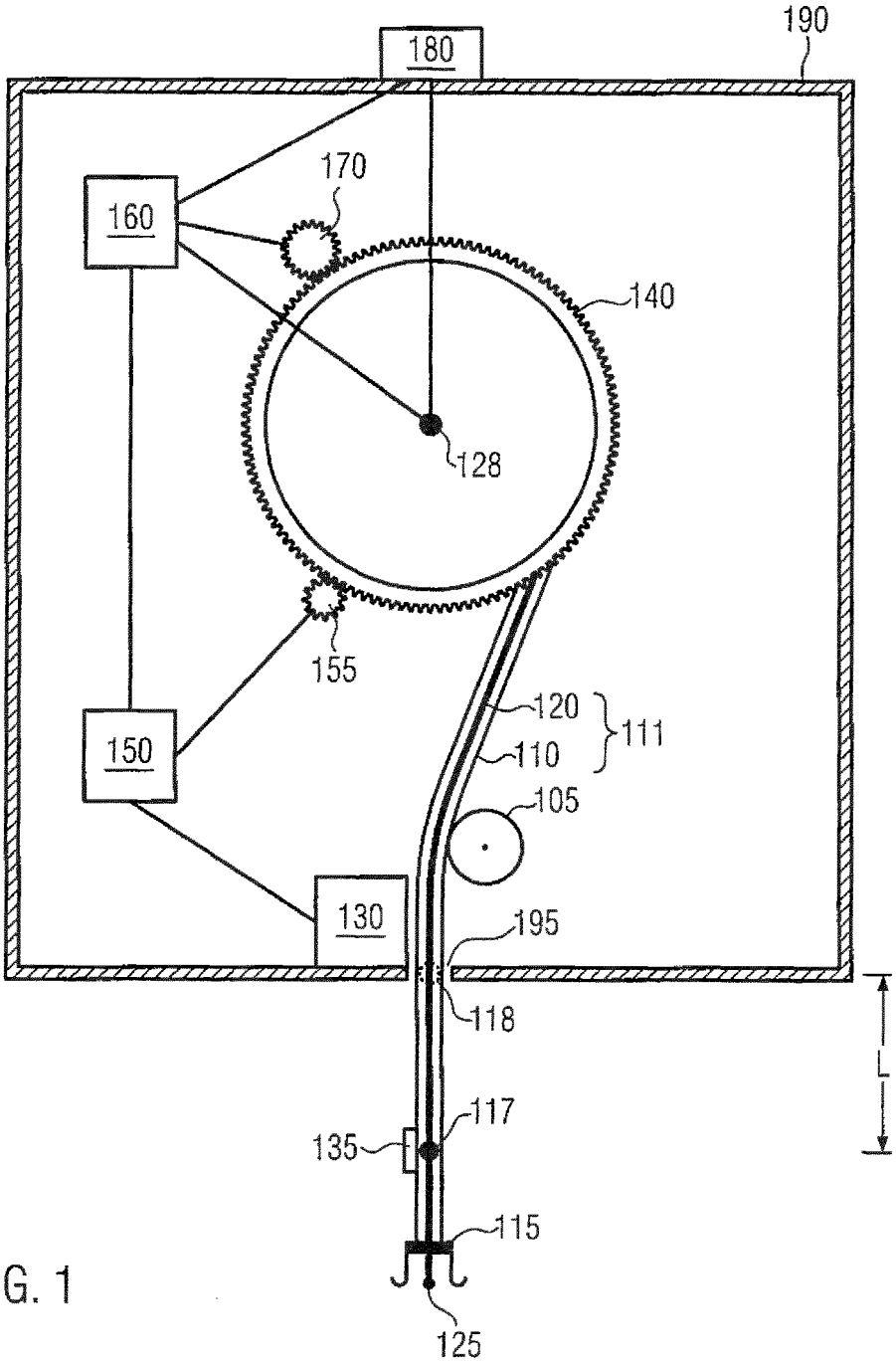
FIG. 1 illustrates an example of a winch according to the present invention.

FIG. 1 illustrates an exemplary embodiment of a winch in accordance with the invention. The winch comprises a framework 190. Attached to the framework 190 is a cable roll 140, where a cable 111 is wound up. The cable 111 comprises a sheathing 110 and at least two wires 120 inside the sheathing 110. The cable carries, at its end hanging down from the winch, a pull relief 115. The pull relief 115 is formed such that an electric device can be pinned on. In this way, the cable can carry the weight of the electric device. The wires 120 inside the sheathing 110 of the cable 111 have a plug 125 at their ends, where the electric device can be electrically connected to the wires. A cable guide roll 105 may be provided to guide unwound cable from the cable roll 140 through an opening 195 in the framework 190 of the winch.

An electric device may be pinned on the pull relief 115. The electric device may also be electrically connected to the plug 125. The plug may be positioned near the pull relief 115 in a distance such that an electric device pinned on the pull relief 115 can be plugged to the plug 125. A magnet 135 is attached to the sheathing 110 of the cable 111. The magnet may be attached to the sheathing near the pull relief 115. The magnet 135 may be attached to the sheathing 110 near the end of the cable 111 which is hanging down from the winch.

A part of the cable 111 is wound around the cable roll 140. In its center, the cable roll has a slip ring 128. The slip ring 128 is used to lead electric current from outside the cable roll 140 into the wires 120 inside the sheathing 110 of the cable. The slip ring is electrically connected to a microprocessor 160. The slip ring may optionally be electrically connected to the interface 180. An external controller, i.e. a controller which is not part of the winch, may be attached to the interface 180. The interface 180 may be configured to forward instructions from an external controller to the slip ring 128. The forwarded instructions may be provided, using the slip ring 128 and the wires 120, to an electric device which may be attached to the plug 125. Alternatively or in addition, the interface is configured to forward instructions from an external controller to the microprocessor 160.

The microprocessor 160 is electrically connected to an electric motor 170. The microprocessor 160 controls the motion of the electric motor. The microprocessor 160 may provide control signals to the electric motor 170, and/or the microprocessor 160 may provide the electric motor 170 with current driving the electric motor. The electric motor 170 is configured to drive the cable roll 140 such that it rotates. The cable roll 140 may be configured to rotate in clockwise and in counterclockwise direction. Dependent on the direction of rotation of the cable roll 140, the cable is wound or unwound. A gear may be used to adapt the rotational speed of the electric motor 170 to a desired rotational speed of the cable roll 140. Alternatively or in addition, a gear may be used to change the rotation of the cable roll 140 from one direction to the reversed direction.

In particular embodiments, the measuring means comprise length tracking means 155 and a magnet sensor 130. The measuring means also comprises a measuring controller 150. The measuring controller 150 may be electrically connected to the microprocessor 160. In particular embodiments, the microprocessor 160 may assume the functionality of the measuring controller 150 besides other tasks. The measuring controller 150 receives data from the length tracking means 155 with respect to the rotational motion which the cable roll 140 performs. The length tracking means 155 may also provide data to the measuring controller 150 about the radius of the coil formed by that part of the cable which is still wound around the cable roll 140.

In an embodiment, the measuring controller 150 is also electrically connected to the magnet sensor 130. The magnet sensor is configured to send a signal to the measuring controller if the magnet 135 attached to the cable is sensed by the magnet sensor 130. The measuring controller is be configured to take the position of the cable roll at the moment when it receives a signal, in particular from the magnet sensor, that the magnet is sensed by the magnet sensor, as a predetermined starting position of the cable roll.

The measuring controller 150 is configured to forward data to the microprocessor 160 specifying whether the magnet 135 is sensed by the magnet sensor 130. The microprocessor 160 may be configured to stop the electric motor 170, for example, by sending a corresponding control instruction to the electric motor 170, if the microprocessor 160 receives data from the measuring controller 150 specifying that the magnet is sensed by the magnetic sensor 130. In this way, the winch can be stopped from winding too much of the cable 111 onto the cable roll 140, and/or to touch the framework 190 with an electric device attached to the pull relief 115.

In a particular embodiment, the length tracking means 155 comprise a rotary encoder which issues signals indicating an angle and/or the amount of rotations by which the cable roll 140 has rotated. The signals are issued to the measuring controller 150. The angle may be measured with respect to the above-mentioned predetermined starting position of the cable roll. In particular, the rotary encoder may issue a signal each time when the cable roll is rotated, starting from the predetermined starting position, by a multiple of a fixed angle. The fixed angle may be 7 degrees.

In an embodiment, the length tracking means comprise a potentiometer. The potentiometer is configured to provide a value, in particular, a resistance value, which indicates an absolute position of the cable roll, to the measuring controller 150. The absolute position may be measured with respect to the above-mentioned predetermined starting position. In this way, the measuring controller 150 can determine the absolute position of the cable roll 140 without winding the cable roll to the predetermined starting position.

Based on the data provided by the length tracking means 155, the measuring controller 150 is configured to keep track of the length of that part of the cable 111 which is wound around the cable roll 140. In particular, the measuring controller may be configured to keep track of the number of rotations which the cable roll has been performed beginning with a predetermined starting position. The measuring controller 150 is configured to provide data to the microprocessor 150. In particular, the measuring controller 150 may provide data to the microprocessor 160 referring to the rotational motion of the cable roll and/or referring to the amount of wound and/or unwound cable.

The measuring controller 150 may also be configured to provide data to the microprocessor 160 specifying at least one of: the length of the part of the cable which has been wound or unwound from the cable roll, the rotational speed of the cable roll, the radius of the coil formed by that part of the cable which is still wound around the cable roll 140.

The interface 180 of an embodiment of the winch is configured to permit forwarding digital and/or analog data. Data can be forwarded from the interface 180 into the winch and can be forwarded from the winch to its outside, for example, to an external controller. Data can be forwarded into the winch from the interface 180 to the microprocessor 160 and to the slip ring 128. The interface 180 may be configured to have an address. The interface 180 may be configured to accept data according to the DMX protocol. The interface 180 may be configured to select, from all the data forwarded to the interface from outside the winch, those data which correspond to the address of the interface.

A predetermined fixed reference point 117 is defined on the cable. In a particular embodiment, the predetermined fixed reference point is located at the position where the magnet 135 is attached to the cable 111. The predetermined reference state of the cable is defined by the spatial arrangement of the cable 111 when the cable is wound around the cable roll 140 such that the predetermined fixed reference point 117 is located at a reference position 118. The position of the predetermined fixed reference point is specified in the same coordinate system as the reference position 118. In particular, the reference position may be in the center of an opening 195 in the framework 190. The length L of unwound cable is given by the length of cable between the reference position 118 and the predetermined fixed reference point 117. In a particular embodiment, the origin of the coordinate system used to specify the reference position may be in the axis of the cable roll.

Figure 2:
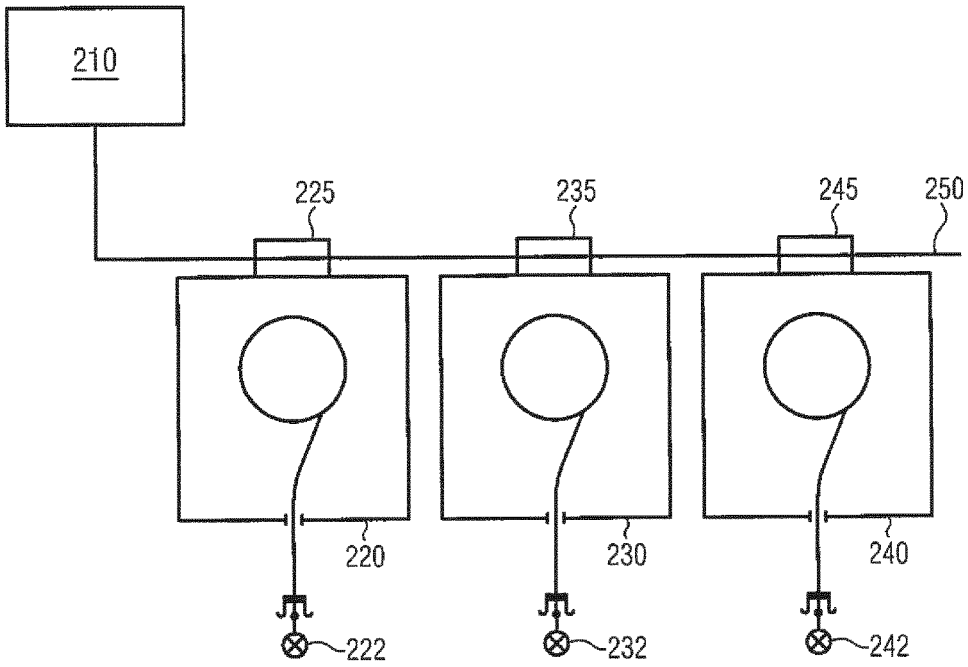
FIG. 2 illustrates an example of a system according to the invention where a system controller is used to control a plurality of winches.

FIG. 2 presents an example of a system for controlling a plurality of winches according to the invention by means of a system controller 210. The winches 220, 230 and 240 are connected to the system controller 210 by a network 250. The network 250 may be a wired and/or wireless network, and the network members may be connected by means of electric cables and/or glass fiber cables. In one embodiment, the winches 220, 230 and 240 are connected to the system controller 210 by a bus system. The network may have, in particular, a bus topology or a star-like topology or a ring topology. In a system with bus-type network, the winches and the system controller may be daisy-chained. For at least a part of the winches, there may be a dedicated connection between the system controller 210 and a particular winch.

In the presented embodiment, a network cable 250 connecting the system controller and the winches 220, 230 and 240 is attached to the interfaces 225, 235 and 245 of the winches. In the presented embodiment, each of the winches 220, 230 and 240 has a respective light emitting device 222, 232 and 242 electrically connected to its cable. A light emitting device may be attached to a pull relief connected to the cable of the respective winch. The cable of each of the winches comprises a sheathing which is wrapped around wires in the inside of the sheathing. The light emitting devices are provided with electricity using the wires inside the sheathing of the cable where a light emitting device is electrically connected to. Each light emitting device is electrically connected to the wires inside the sheathing of a cable by means of a plug attached to the wires. The system controller is configured to issue instructions to each particular winch to control winding or unwinding the cable of the winch. Those instructions may be executed by a microprocessor in the winch. The system controller may also be configured to issue instructions which are directed to the light emitting device electrically connected to a particular winch.

In other embodiments, an electric device which generates an output signal, like a light sensitive device and/or a microphone, may be electrically connected to the cable of at least one of the winches. The output signal from such a device may be transmitted, using the wires in the sheathing of the cable and in the interface of the winch, to the system controller. The system controller may be configured to issue instructions to a winch or to issue instructions to an electric device, in particular, to a light emitting device, electrically connected to the cable of a winch, in response to the output signal of an electric device electrically connected to the cable of a winch. In particular embodiments, the electric device which generates an output signal is a microphone.

In some embodiments, the system controller 210 has stored, for at least one of the plurality of winches 220, 230, 240 which it is enabled to communicate to, a length value specifying a length of cable which has to be unwound by the at least one of the plurality of winches. By having stored length values for each of a plurality of winches, the controller may send instructions to the winches such that the devices, for example, light emitting devices, electrically connected to the winches, form a spatial pattern. In particular embodiments, the length values may be based on function values of a function of one or two variables.

Alternatively or in addition, the system controller may issue instructions to the electric devices electrically connected to the winches. In particular, the system controller may cause electric devices which are light emitting devices to change the brightness of the emitted light. The light emitting devices may comprise light sources with different colors. The system controller may cause the light source to change its color and/or to change its brightness. The external controller may coordinate changes in a light source electrically connected to the cable of a winch with the motion of the winch. By issuing corresponding instructions to a winch as well as instructions to the device electrically connected to the cable of the winch, the system controller may adjust electric devices electrically connected to the cables of a plurality of the winches individually in height. Hence, the external controller may be prepared to provide a spatial pattern of light sources changing their position as well as the emitted light in a coordinated way.

Each winch may be fastened to a ceiling at a predetermined fastening location. The winches may be fastened to a truss system. The truss system may be incorporated into an interior which can be used for installing works of art and/or is intended to comprise some kind of eye-catcher. In particular, such interior may be a trade fair booth ceiling, a show window, a hall in a museum, an environment of a stage, a building at an airport, an atrium of a building or a staircase.

For each winch, a required length value of unwound cable may be derived, by the system controller, from the value of a function having the predetermined fastening location of the winch at the ceiling as input. The system controller may issue one or more instructions to a winch specifying the length of unwound cable to be provided by the winch. By issuing at least one instruction to each of the winches specifying a length of unwound cable based on the length value derived for that winch, the system controller may control the winches such that the electric devices electrically connected to the cables of the winches form a spatial pattern which corresponds to a graph of the function. The length value specified by the system controller 210 in the instructions addressed to a particular winch may vary with time.

In other embodiments, there is at least one electrical device which is connected to more than one of the plurality of winches 220, 230, 240. In particular cases, there is a plurality of attachment points on an electrical device, each of which is pinned on the cable of one of a plurality of winches. Each of the attachment points may be electrically connected to the electrical device. On at least one of the attachment points, the electrical device may be plugged to wires inside the sheathing of the cable of one of the plurality of winches to be electrically connected. The electrical device may be provided with electric power and/or with digital data, such as instructions, by means of the wires inside the sheathing of the cable of at least one of the winches. Instructions to the electric device may be provided from the processing means, in particular, from a microprocessor comprised in at least one of the winches whose cable is pinned on one of the attachment points. Alternatively or in addition, instructions to the electrical device may be provided from the system controller.

The instructions issued by the system controller 210 to the plurality of winches may cause the winches which the electrical device is electrically connected to and/or pinned to wind or unwind their cables. In this way, the attachment points of the electrical device electrically connected to the cables of more than one winch are moved in a coordinated way. In this way, the system controller may cause the electrical device, for example, a large and/or heavy one, to be moved up and down by more than one plurality of winches simultaneously. The motion of the winches may be controlled by the system controller such that an electrical device is tilted and/or inclined and/or turned in a particular way by causing the winches winding or unwinding their cables with different speed. If several electrical devices are electrically connected and/or pinned to more than one winch and are moved in this way, a moving pattern may be created by making the devices move in a similar or identical way. A similar or identical motion of one of the devices may be deferred with respect to the motion of another one of the devices so as to simulate a spatial progress of the motion of a device. A winch may wind/unwind its cable with a linear speed which does not depend on the length of the cable which is wound or unwound. Hence, the motion of a device may not depend on the distance between an electrical device and the ceiling or the ground.

In particular, the electrical devices may be fluorescent tubes. The fluorescent tubes may be linear tubes. A fluorescent tube may be attached, in particular, electrically connected and/or pinned at each of its ends to a different winch of a plurality of winches. A fluorescent tube may have, in particular, a color of red, green or blue. The external controller may be configured to issue instructions to a winch where one end of a fluorescent tube is attached so as to shorten the unwound part of the cable, and may be configured to issue instructions to a winch where the other end of the fluorescent tube is attached to so as to lengthen the part of unwound cable. Alternatively, the system controller can issue instructions to winches where a fluorescent tube is attached so as to lengthen their cable or to shorten their cable. Shortening or lengthening of the cables may be carried out with different velocities and/or accelerations of the cable or of the cable roll. In this way, the system controller may be prepared to cause a rocking motion of the fluorescent tube. The rocking motion may be combined with an up or down movement of the fluorescent tube.

In yet another embodiment of a system according to the invention, a plurality of winches is attached to a floor. The winches may be attached to the floor in a rectangular pattern. At each of the winches, a container comprising an illumination is attached to the cable of the winch. The container may be filled with a gas which is lighter than the air surrounding the container. For example, the container may be a balloon. The balloon may be filled with helium, or the balloon may be filled with heated air. By winding or unwinding the cable of the winch which the balloon is attached to, the balloon can be moved up or down.

In an embodiment, the system controller may be prepared to control the motion of each of the plurality of winches, and may create a spatial pattern formed by balloons, each balloon attached to a winch, each balloon comprising a light source, the balloons floating in the air. The system controller may coordinate the motion of the balloons in the air with changes of the light emitted by a light source in each balloon. A particular kind of motion may be accompanied by a particular kind of light emission. For example, moving the balloon up or down may be accompanied by emitting green light which increases with brightness dependent on the height of the balloon over the floor. The light source in a balloon may be a dimmable LED. The movement of a balloon may be accompanied by sonic events. The sonic events may be sound emissions from at least one loudspeaker arranged in a room where the winches are attached to the floor. The at least one loudspeaker may be located inside at least one balloons.

Figure 3A:
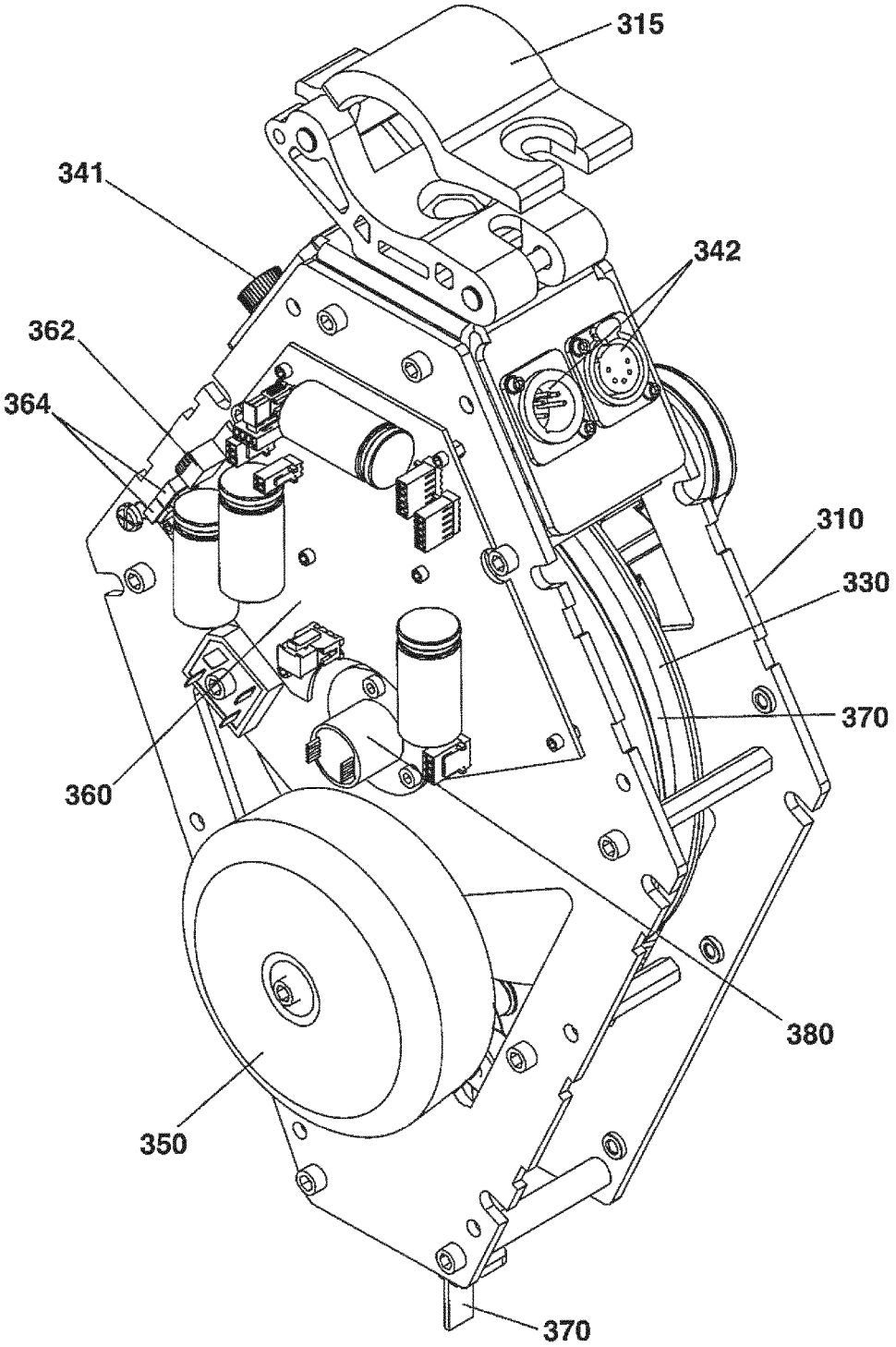
FIG. 3 illustrates an arrangement of components in an exemplary embodiment of a winch according to the invention.
Figure 3B:
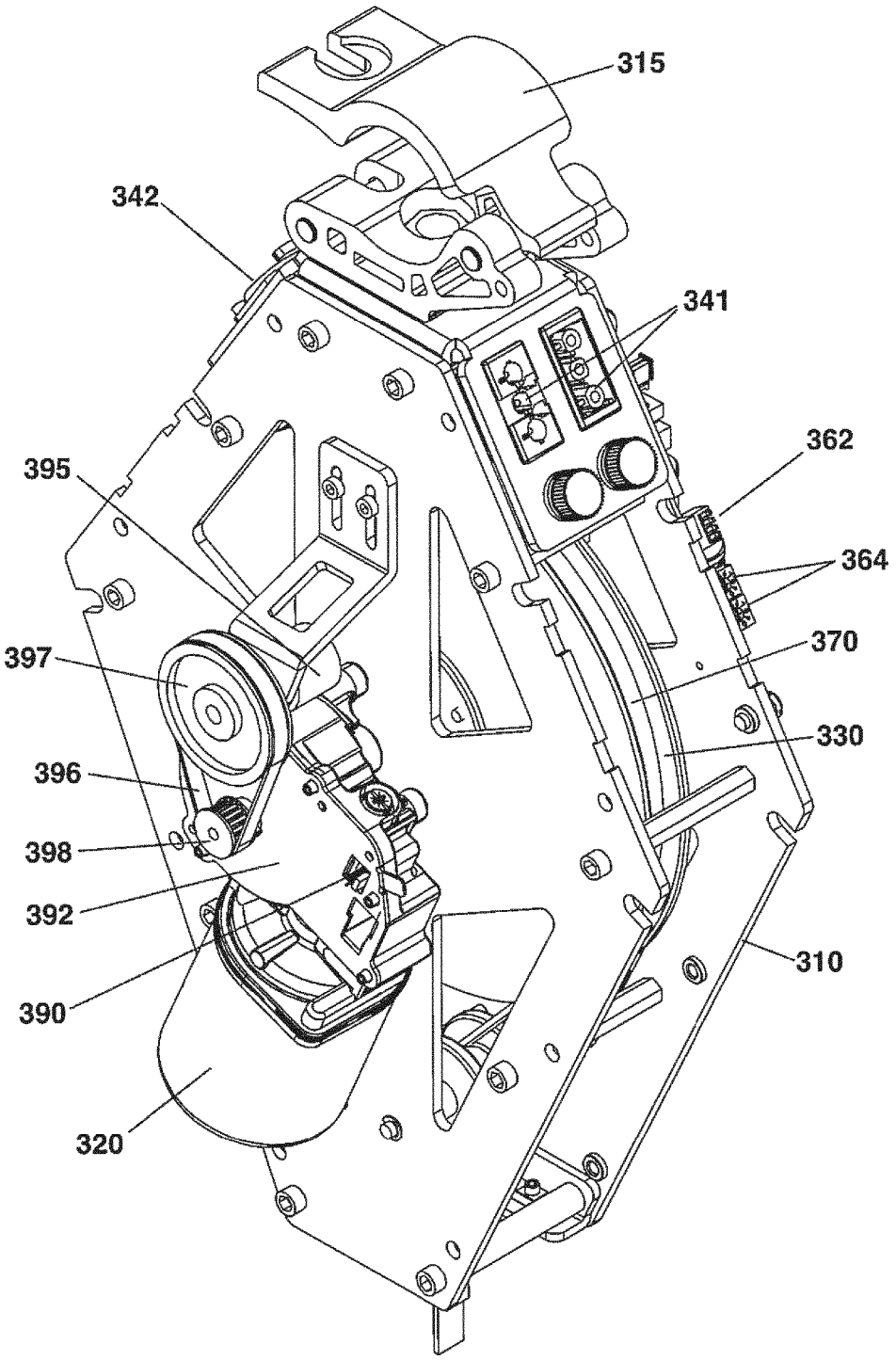

FIG. 3 illustrates an arrangement of components in an exemplary embodiment of a winch according to the invention. FIGS. 3*a* and 3*b* show the winch as seen from two opposite sides.

FIG. 3*a* illustrates that attached to a framework 310 is an interface which has two separate portions, a power portion 341 which is used to supply electric power to the winch, and a data portion 342 which is used to provide data to the winch. In a particular embodiment, the data portion comprises a plug and a socket as used for a DMX bus. Further mounted on the framework is a circuit board 360 carrying electronic components configured to enable operation of the winch.

In particular, the circuit board 360 comprises at least one microprocessor and has attached conducting wires connecting the circuit board with electric components of the winch. The circuit board 360 further carries dials 364. With the dials 364, an address can be set for the winch which can be used to address the interface of the winch. Data which are intended to be used by the winch or by an electric device electrically connected to the cable 370 of the winch can be sent to the address set with the dials 364. The circuit board 360 also carries dip switches 362. The dip switches 362 may be used to select an operation mode for the winch. In particular, the dip switches 362 may be used to set the winch into an adjustment mode, or into a play mode. In adjustment mode, the winch may be configured to carry out particular actions. In play mode, the winch actually may carry out actions which it has been configured to carry out.

The embodiment further comprises a transformer 350. The transformer 350 is configured to provide power to the circuit board 360 and to an electric motor 320 which is mounted on the opposite side of the framework 310 and which is configured to drive the cable roll 330. A cable 370 with a sheathing having a rectangular cross section with rounded-down corners, which surrounds electric wires, is wound around the cable roll 330. The electric wires leading through the cable 370 are connected to wires from a slip ring 380 whose axis coincides with the axis of the cable roll 330.

On top of the framework 310, a clip 315 is attached to the framework 310. The clip 315 is used to attach the framework 310 of a winch to some kind of truss or other supporting device.

FIG. 3*b* illustrates the arrangement of components of a winch according to the invention from the side opposed to that shown in FIG. 3*a*. Mounted on the framework 310 is an electric motor 320 which is configured to drive the cable roll 330 of the winch. Attached to the electric motor 320 is a gear 392 which adapts the rotational velocity of the electric motor 320 to the rotational velocity of the cable roll 330. Further attached to the electric motor 320 is an encoder 390 which is configured to provide data to a circuit on the circuit board 360 indicating a rotational motion of the cable roll 330. Mounted to the framework is a potentiometer 395 which provides information about the position of the cable roll 330 relative to a start position to circuitry on the circuit board 360. The potentiometer 395 is driven using a belt 396 which connects a roll 397 attached to the axis of the potentiometer 395 with a second roll 398 which is driven by the motor 320 by means of gear 392. In an embodiment, the rolls 397, 398 as well as the belt 396 may be toothed so as to avoid slipping of the belt 396.

Figure 4A:
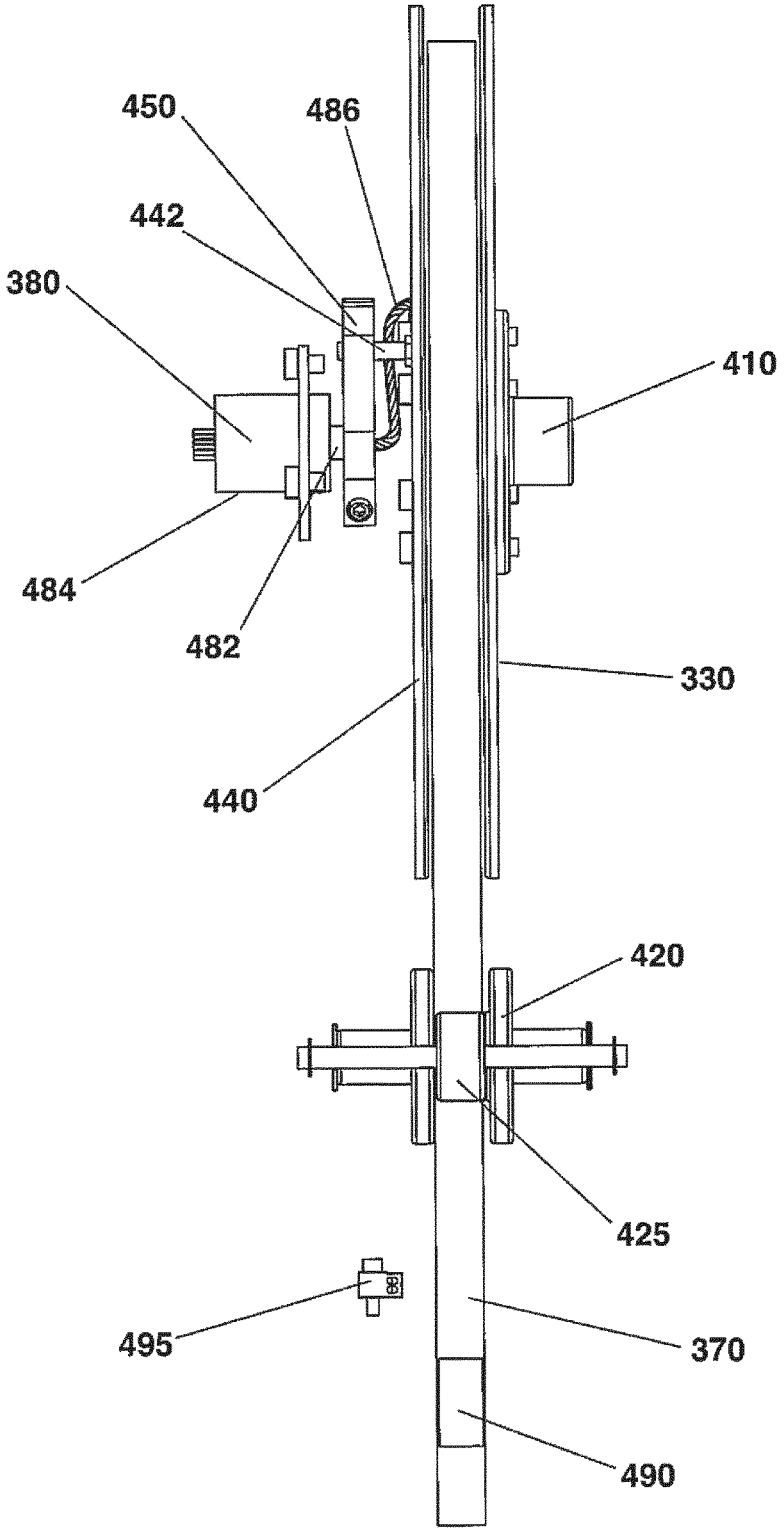
FIG. 4 illustrates an exemplary embodiment of a cable roll and a slip ring in a winch according to the invention.
Figure 4B:
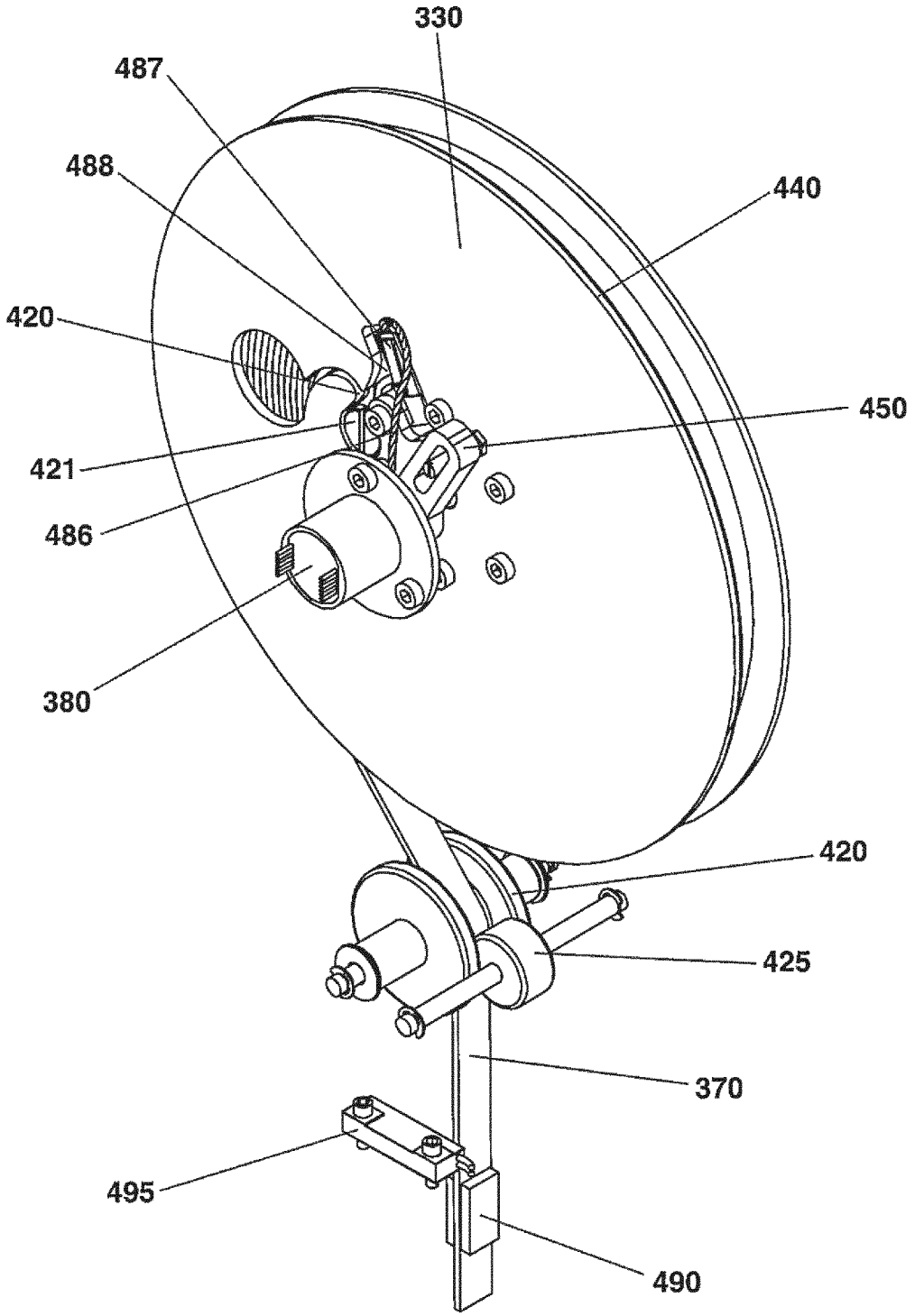

FIGS. 4*a* and 4*b* illustrate an example of an arrangement of the cable roll 330 and a slip ring 380 as included in a particular embodiment of the winch. A cable 370 with a sheathing having a rectangular cross section with smoothed-down corners and which encloses wires is wound around the cable roll 330. On one side of the cable roll 330, centered on the axis of the cable roll, is an axis stub 410. The axis stub 410 is prepared to be inserted into a bearing which is attached to the framework 310 of the winch.

The cable 370 is attached with a screw 421 to the cable roll 430 near one of its end points.

The wires inside the sheathing of the cable 370 are led from an end point of the sheathing into a socket 488 embedded into a side portion 440 of the cable roll 330. The socket 488 is configured to be connected to a plug 487. A plug 487 is attached to the end of the cables 486 which are led out of the movable part 482 of the slip ring. The plug 487 may be sunk in an opening in the side portion 440 of the cable roll 330 when it is connected to the socket 488. In one embodiment, the opening in the side portion 440 of the cable roll is centered on the axis of the cable roll 330.

A connector element 450 is fixed to the movable part 482 of a slip ring 380. The slip ring 380 is prepared to be mounted to the framework 310 of the winch such that the axis of its movable part 482 coincides with the axis of the cable roll 330. The connector element 450 and the movable part 482 of the slip ring 380 are rigidly coupled. A pin 442, which is attached to the side portion 440 of the cable roll 430, extends into an opening of the connector element 450. Hence, if the cable roll 330 rotates, the connector element 450 as well as the movable part 482 of the slip ring 380 rotate together with the cable roll 330. As the axis of the slip ring 380 coincides with that of the cable roll 330, the movable part 482 of the slip ring 380 can follow the rotation of the cable roll 330.

In this way, the wires coming out of the cable roll 330 and leading into the movable part 482 of the slip ring 380 are not subjected to forces caused by the rotation of the cable roll 330. An electric signal which is to be led into the wires inside the sheathing of the cable is led into the fixed part 484 of the slip ring, from there into the movable part 482 of the slip ring, and from there through the wires 486 coming out of the movable part 482 of the slip ring into the plug 487, from there into the socket 488, where the plug 487 is inserted, and then into the wires inside the sheathing of the cable 370, which are attached to the socket 488.

The cable 370 is guided by the cable guide rolls 420 and 425. The roll 425 is arranged such that a portion of the cable 370 which is unwound from the cable roll 330 is guided between the side portions of the roll 420 and the roll 425. In this way, the cable can be lead out of the winch without passing sharp edges. In addition, the friction force exerted on the cable 370 is kept low.

Attached to the cable is a magnet 490. In addition, a magnet sensor 495, in particular, a hall sensor, or a reed sensor, is attached to the framework 310 of the winch. The magnet sensor is attached at a location of the framework 310 of the winch where the cable 370, in particular the magnet 490 attached to the cable 370, comes close enough to the magnet sensor 495 that the magnet sensor 495 can sense the magnet 490 attached to the cable 370 if the magnet 490 is moved close to the magnet sensor 495 by winding or unwinding the cable 370.

Figure 4C:
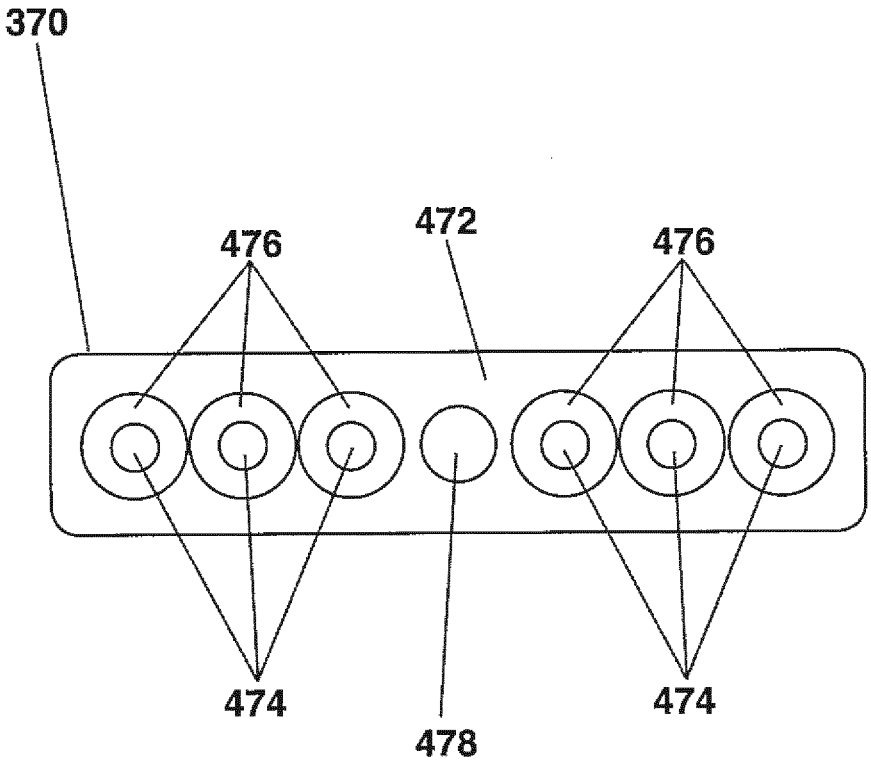

FIG. 4*c* illustrates a cross-section of an exemplary cable 370 of a winch according to the invention. The cable comprises a sheathing 472, where electrically conducting wires 474, surrounded by an isolating material 476, are embedded. The cross section of the sheathing 472 is rectangular in shape, with rounded-down corners. In the illustrated embodiment, six electrically conducting wires are embedded in the sheathing, wherein the six wires are arranged in two groups of three wires each. The two groups of wires are located in a left and a right portion of the sheathing 472. At or near the center of the sheathing, a thread 478 made of resilient material is embedded to support a high weight attached to the cable. In particular, the central thread 478 may be made of non-stretchable material so as to prevent an extension of the cable if a high weight is attached to the cable 370. In an embodiment, the central thread 478 may be made from aramide yarn.

Figure 5:
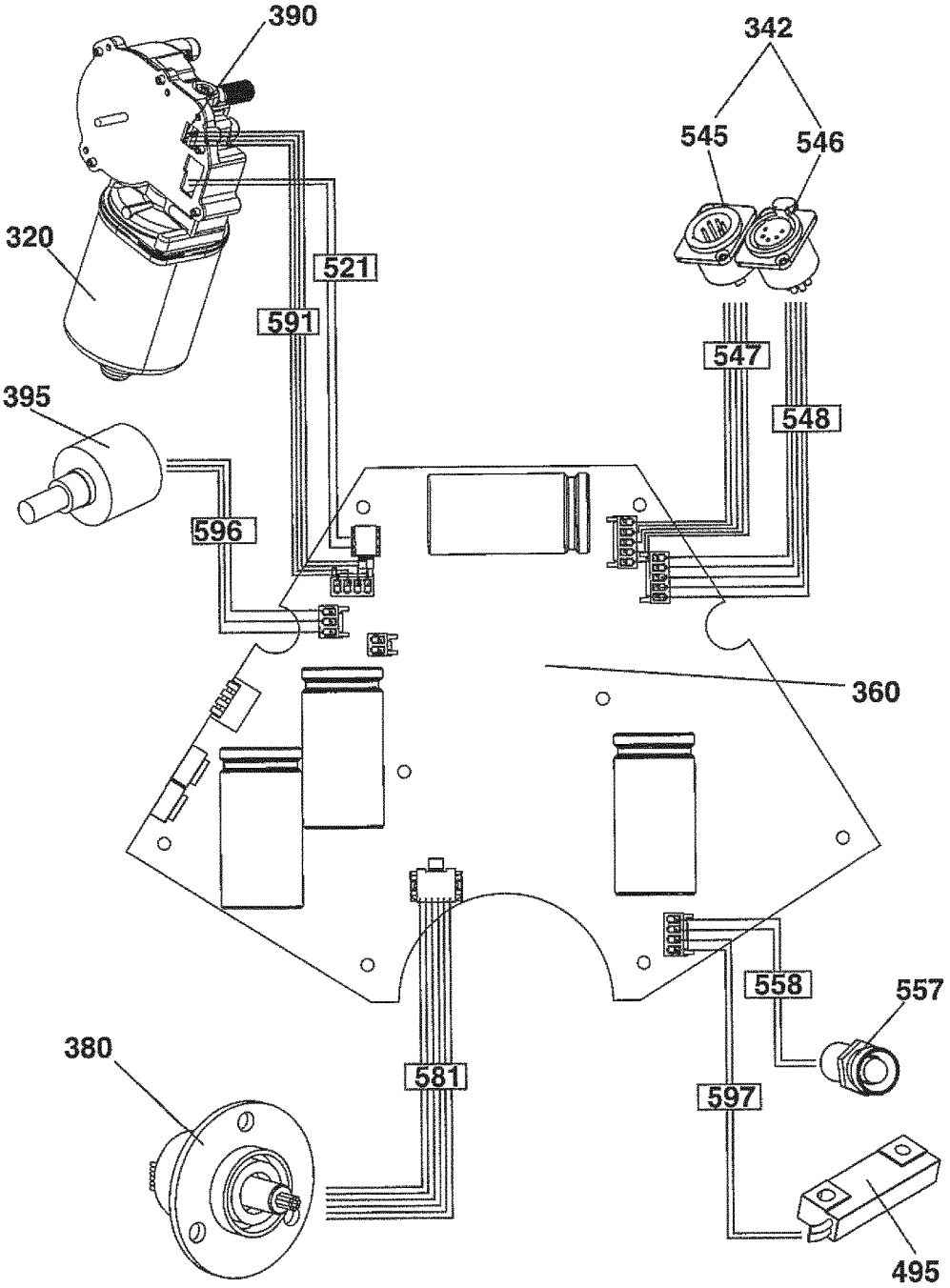
FIG. 5 illustrates, for a particular embodiment, electronic components connected to a circuit board in a winch according to the invention.

FIG. 5 illustrates an example of a circuit board 360 in a winch according to the invention and components of the winch which are electrically connected to the circuit board. The circuit board 360 carries at least one microprocessor which is configured to process data provided from the devices connected to the circuit board. The microprocessor may further be configured to cause signals to be sent to at least one of the devices connected to the circuit board.

There is an electrical connection 521 from the circuit board 360 to the electric motor 320. In this way, the electric motor 320 is supplied with electric power, and/or with control data. Moreover, an electric wiring 591 exists between the encoder 390, which is configured to provide data referring to the rotational motion of the cable roll to the circuit board. Using this electric wiring 591, data provided by the encoder 390 can be received by circuitry on the circuit board 360. Further, there is an electric connection 551 between the circuit board 360 and the potentiometer 395 to obtain data provided by the potentiometer 395, in particular data specifying the position of the cable roll 330 of the winch relative to a start position.

An electric connection 581 is provided between the circuit board 360 and the slip ring 380. This electric connection 581 comprises wires for electric power and/or data which are provided to an electric device which is attached to the cable 370 of the winch using the clip ring 380. Power and/or data to be sent to an electric device attached to the cable of the winch is provided by circuitry on the circuit board via electric wires to the slip ring 380. Furthermore, there is an electric connection 556 to a sensor 495 in the winch, in particular, a magnet sensor. In this way, circuitry in the circuit board receives information if a magnet, in particular, a magnet attached to a particular location on the cable, is sensed by the sensor 495. In this way, circuitry on the circuit board 360 may be enabled to stop operation of the motor 320, in particular, stop its power supply, if a particular location of the cable marked by the attached magnet is sensed by the sensor 495. There is also an electric connection 558 to a light source 557, in particular, to a LED (light emitting diode), which is controlled by circuitry on the circuit board 360 to provide information about a state of operation of the winch.

The circuit board 360 also has electric connections 547, 548 to an interface 342, in particular, to the data portion 342 of an interface, in particular, to an interface to a DMX bus. Using these electric connections 547, 548, the circuitry on the circuit board is provided with instructions concerning the requested operation of the winch received by the data portion 342 of the interface, and/or instructions concerning the behavior of an electric device electrically connected to the cable of the winch. Alternatively or in addition, the winch may be supplied with electric power by the power portion 341 of the interface. The electric power received by the interface 341 may be used for the operation of the circuitry on the circuit board. Alternatively or in addition, the electric power may be used to permit operation of electric devices in the winch and/or of electric devices which are attached to the cable of the winch. An electric component in the winch may be provided with electric power via an electric connection between the electric component and the circuit board. Alternatively or in addition, a component of the winch, in particular, the electric motor 320 or the transformer 350, may be supplied with electric power from the power portion 341 of the interface.

The data portion 342 of the interface comprises an incoming part 545 and an outgoing part 546. In this way, the interface may be connected to a bus system like a DMX bus. In particular, DMX data may be received by the incoming part 545 of data portion of the interface. Received DMX data may be forwarded by means of electric connections 547 from the incoming part of the interface 545 to circuitry on the circuit board 360. DMX data received at the incoming part 545 of the interface may be provided, using electric wiring 547, 548, from the incoming part 545 to the outgoing part 546 of the data portion 542 of the interface.

The circuit board 360 further carries a set of dip switches 362 and dials 364. By setting the dip switches 362 in a particular way, the behavior of the circuitry mounted on the circuit board, in particular, of the microprocessor, can be controlled. The dials 364 can be set to particular values to specify the address of the winch on the bus system connected to the interface 342, in particular, the address of the winch on a DMX bus.

Figure 6:
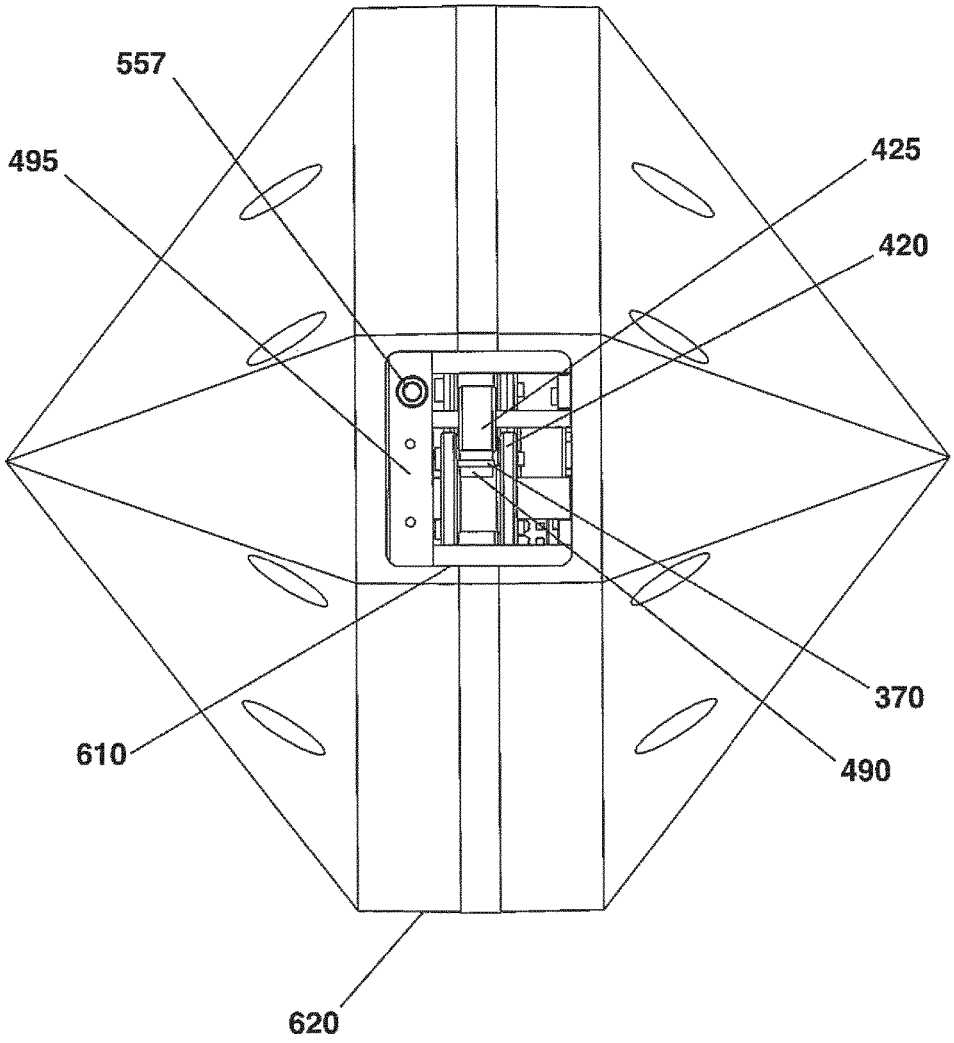
FIG. 6 illustrates a view onto the bottom of an exemplary embodiment of a winch according to the invention.
Figure 7A:
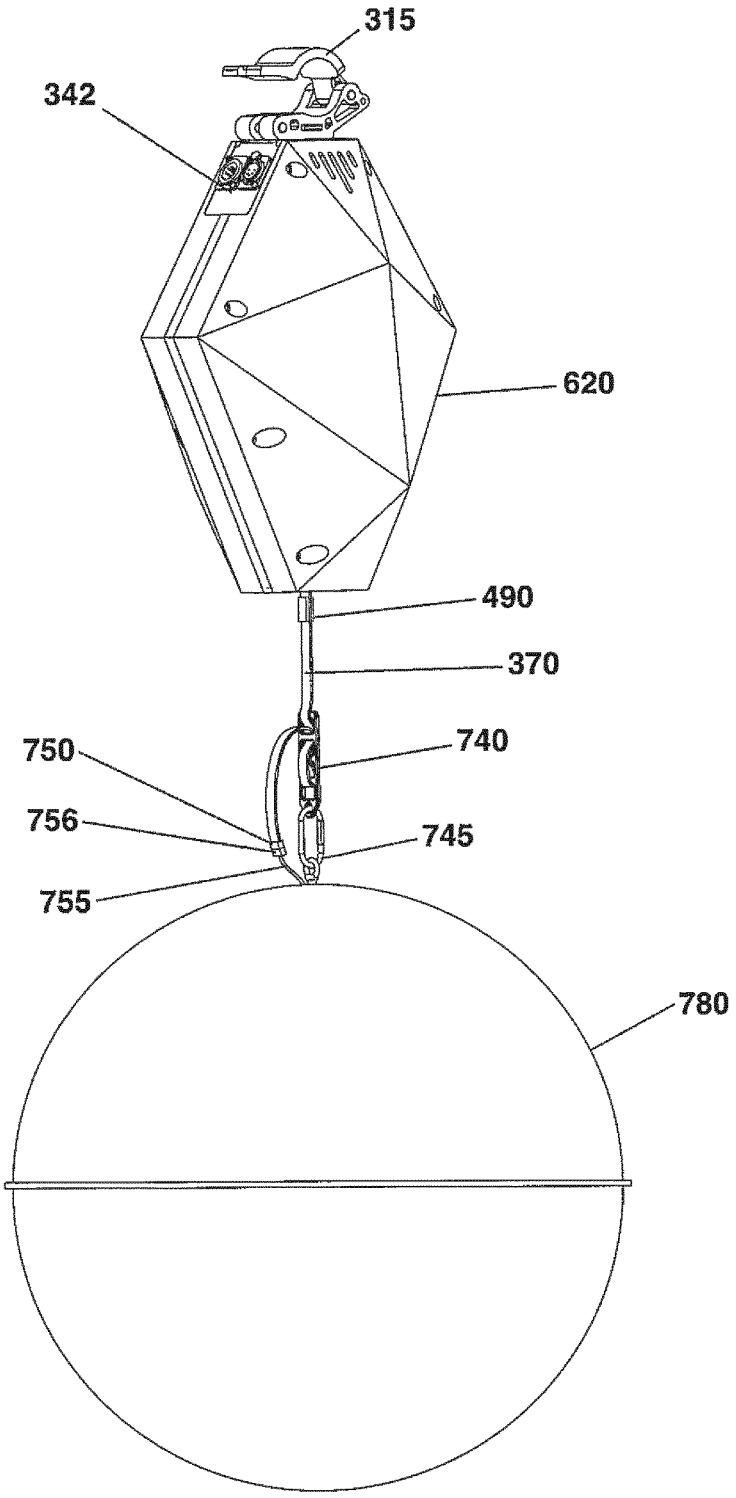
FIG. 7 illustrates an example of an embodiment of a winch with an electrically connected electric device according to the invention.
Figure 7B:
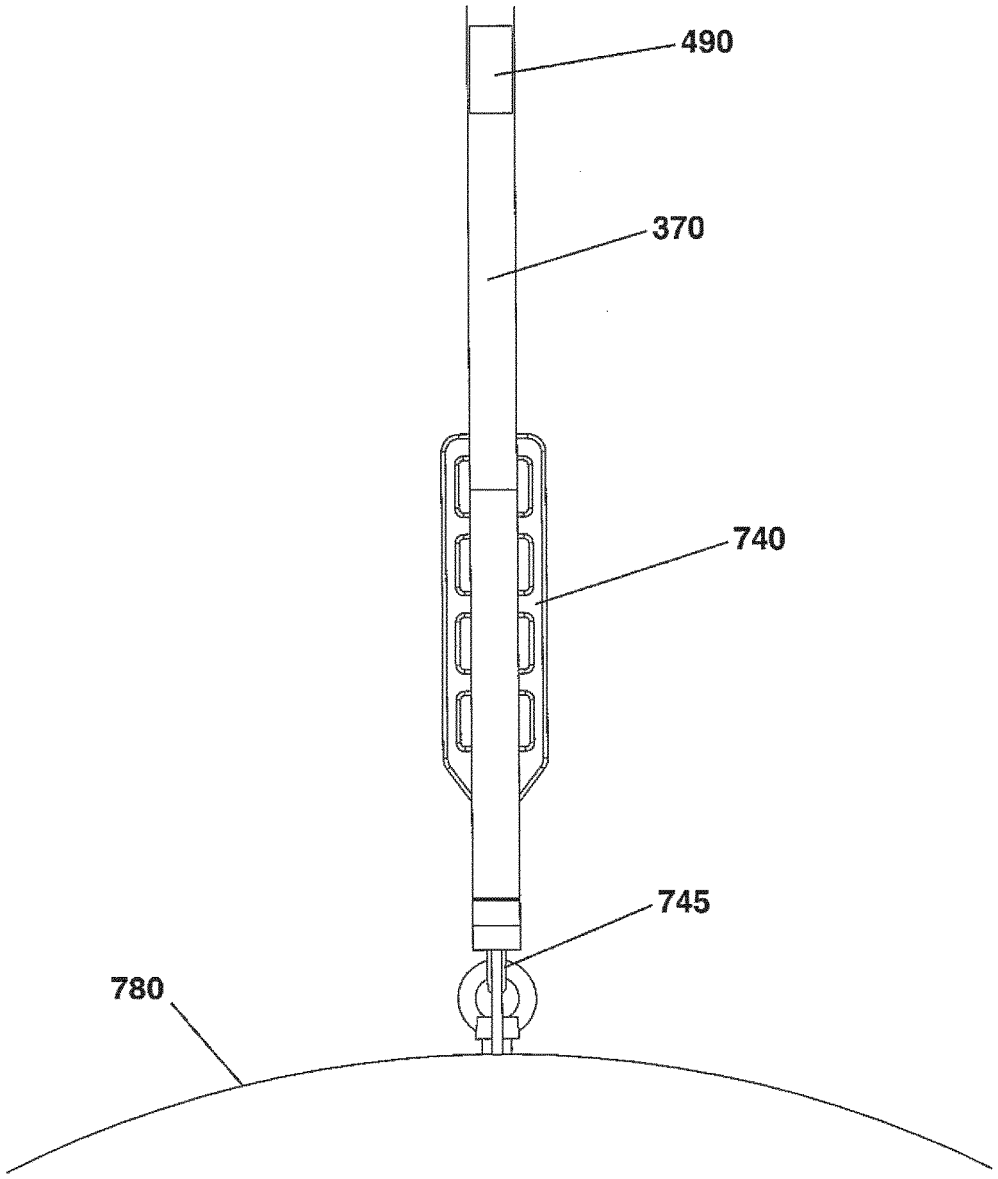
Figure 7C:
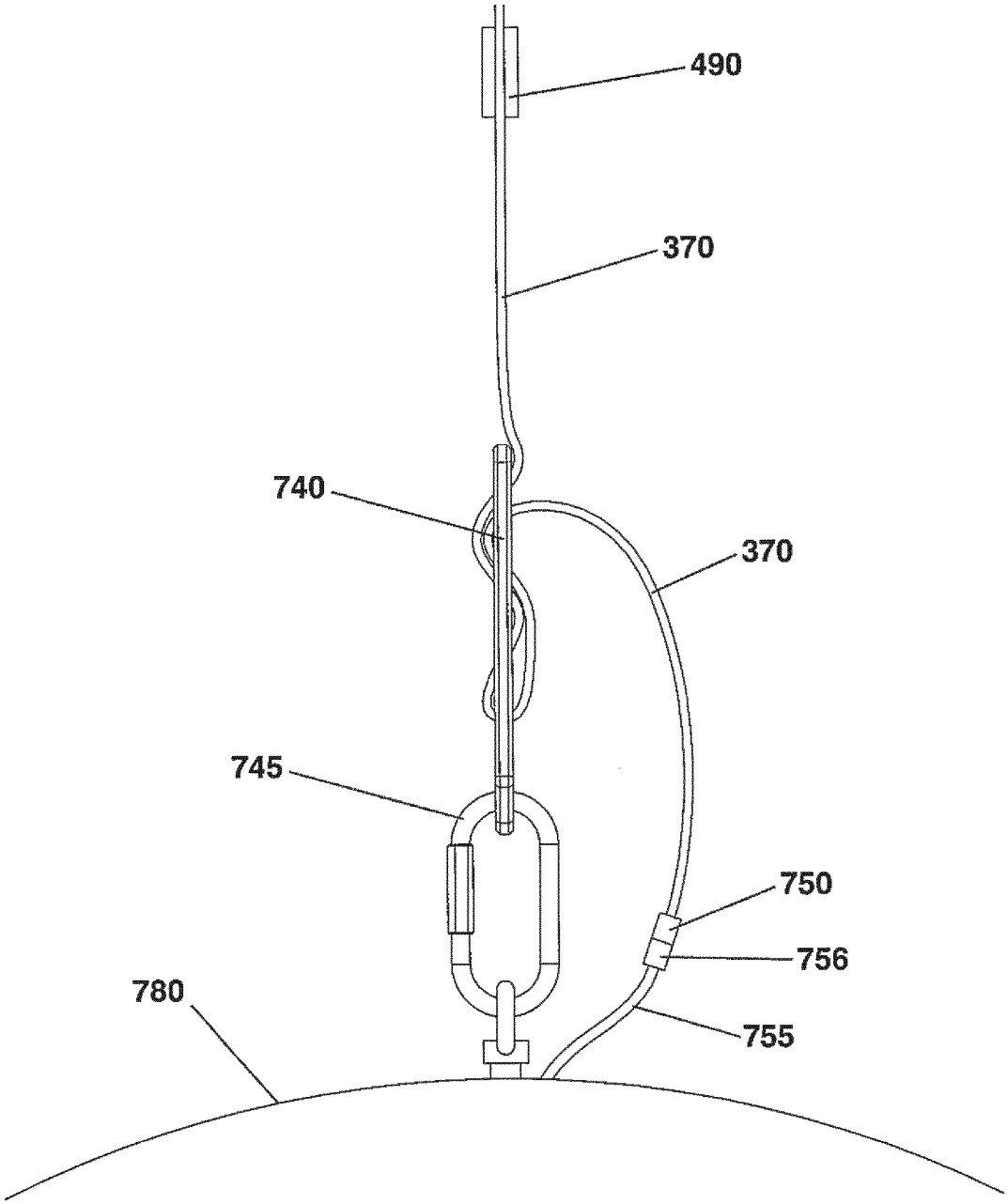
Figure 7D:
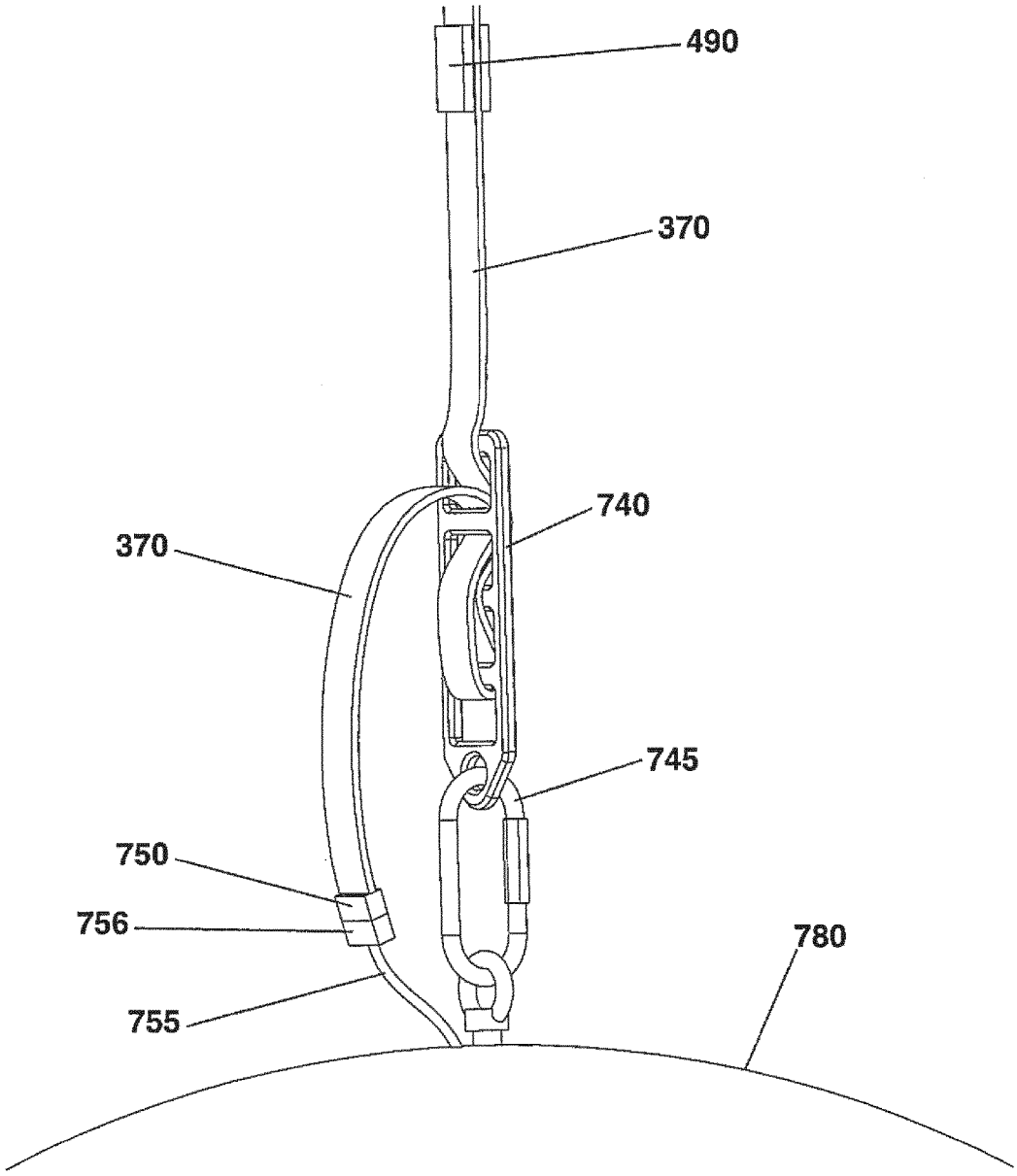

FIG. 6 illustrates a view onto the bottom of an exemplary embodiment of a winch according to the invention. Here, the framework of the winch is surrounded by a solid protective shell 620. At the bottom of the protective shell 620, there is an opening 610. Through the opening 610, the cable 370 hangs out of the protective shell of the winch. Through the opening 610, the cable guide rolls 420 and 425 are visible. At a side of the opening 610, there is a status LED 557 which informs a user about the operational mode of the winch. Further, a magnet sensor 495 is mounted at one side of the opening 610. Moreover, a magnet 490 is attached to the cable 370. If the cable is wound into the protective shell 620 through the opening 610, the magnet 490 passes the magnet sensor 495. The magnet sensor 495 may then send a signal indicating that the magnet 490 is sensed to circuitry controlling the winch. In this way, the circuitry can ensure that the cable is not wound up such far that the attached magnet 490 is pulled into the winch.

FIGS. 7 *a-d* illustrate views of an example of an embodiment of a winch according to the invention. As illustrated by FIG. 7*a*, the winch is covered by a protective shell 620. A clip 315 is mounted on top of the winch and serves to attach the winch to a kind of support. In the upper part of the winch, plugs 342 of an interface of the winch are lead out of the protective shell. In an embodiment, the interface 342 comprises two plugs designed for incoming and outgoing data of a DMX bus. At the bottom of the protective shell 620, the cable 370 of the winch hangs out of the protective shell 620 through an opening in the shell 620.

As is also illustrated in FIGS. 7 *b-d*, which show an end portion of the cable 370, a magnet 490 is attached to the part of the cable 370 which hangs out of the protective shell 620. Near the magnet 490, a pull relief 740 is pinned on the cable 370. A plug 750 is fastened to the end of the cable 370. The plug 750 is configured to provide an electrical connection to wires inside the cable 370. The input lead 755 of a lamp 780 has a corresponding plug 756 at its end, and the plug 756 at the end of the input lead 755 can be plugged into the plug 750 at the end of the cable to establish an electric connection between the lamp and the wires inside the cable 370 of the winch. The lamp 780 may be mechanically attached to the pull relief 740 via a connection ring 745. The pull relief 740 permits passing on the weight force of the lamp 780 to the cable 370 without putting mechanical stress to the electrical connection between the plug 750 at the end of the cable 370 and the plug 756 at the end of the input lead 755 of the lamp 780. The pull relief 740 has the form of a ladder with a number of rungs, in particular, 4 rungs. To achieve the effect of passing on weight force of the lamp 780 from the connection ring 745 to the cable 770, the cable 770 is threaded through the rungs of the pull relief 740, in particular, first from one end of the pull relief 640 to the other, and then in opposite direction, as illustrated in FIGS. 7*b-d*.

Figure 8:
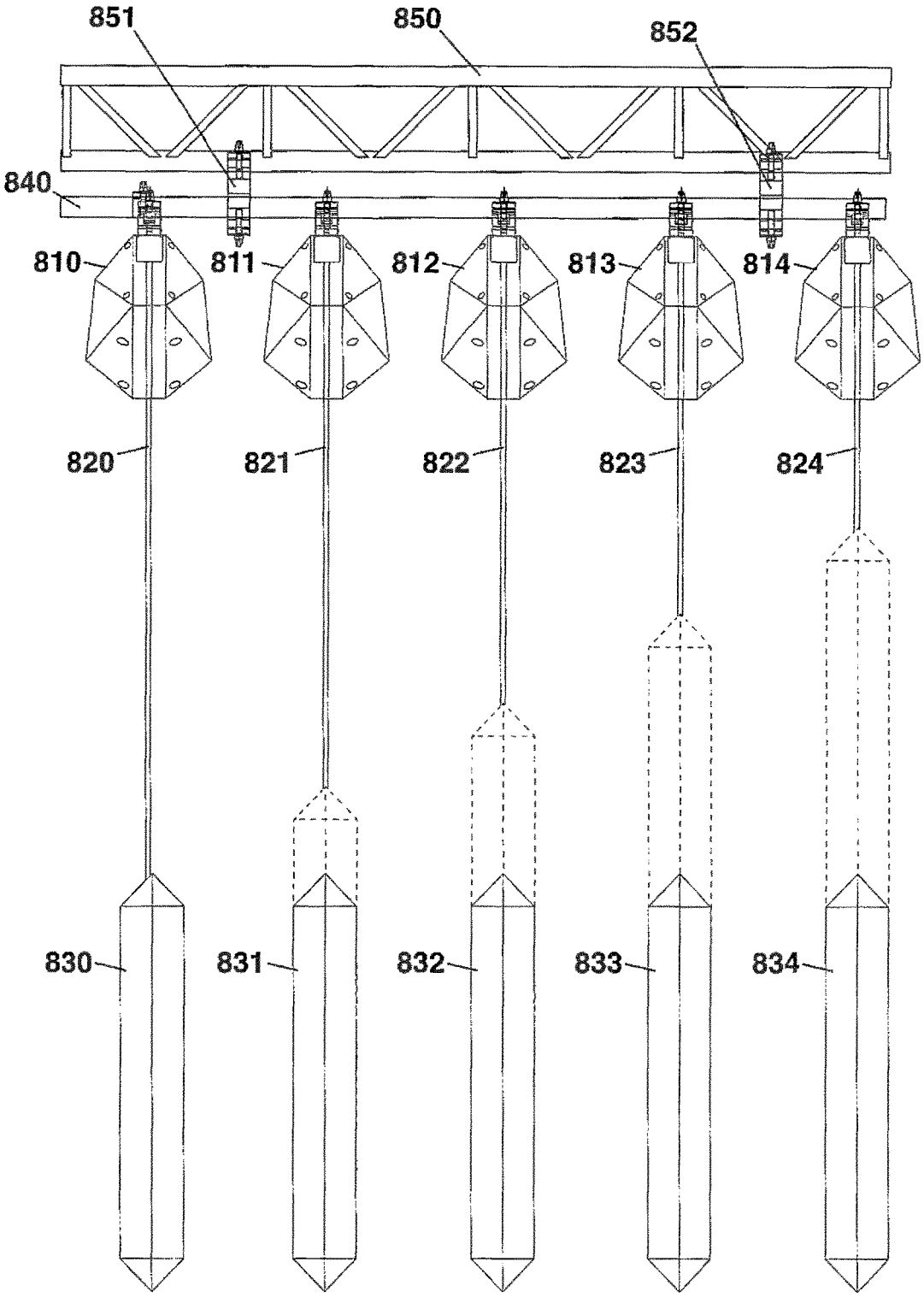
FIG. 8 illustrates a particular embodiment of a system of winches according to the invention.

FIG. 8 illustrates a particular embodiment of a system of winches according to the invention. The winches 810, 811, 812, 813 and 814 are attached to a pole 840 by a clamp. The pole is connected to a truss 850 using clamps 851, 852. The winches 810, 811, 812, 813 and 814 are connected to a system controller, for example, a PC. Each of the winches has a DMX input plug and a DMX output plug. The system controller is electrically connected to the input plug of one of the winches, for example, of winch 810. The winches 810, 811, 812, 813 and 814 are daisy chained so that each winch has access to the DMX bus and thus, the possibility to receive data sent by the system controller. Each winch comprises dials where an address of the winch can be set. Each winch uses the address specified by its dials to determine which of the data on the DMX bus are directed to it.

At the cables 820, 821, 822, 823, and 824 of the winches 810, 811, 812, 813 and 814, electric devices 830, 831, 832, 833 and 834 are electrically connected. In a particular embodiment, the system controller issues instructions to the winches which cause an addressed winches to wind or unwind its cable roll such that the respective connected electric device is at a distance from the winch which is different for each of the winches.

In particular, the respective distance of the electric devices 830, 831, 832, 833 and 834 from the corresponding winches 810, 811, 812, 813 and 814 may be determined by the system controller as value of a chosen function of one variable. If the variable is the distance of the clamp which attaches the winch to the pole 840 from an end of the pole, then the system controller may send instructions to the winches wherein the requested distance between the connected electric device and the pole 840 is the value of the chosen function, wherein the distance of the clamp which attaches the respective winch on the pole from an end of the pole is taken as argument.

In this way, the requested locations of the requested devices may mark points on a graph of the chosen function.

For example, if the chosen function is the equation of a straight line, then the locations of the electric devices 830, 831, 832, 833 and 834 mark locations on a straight line. Such a situation is illustrated by the dashed lines in FIG. 8. In another example, if the chosen function is the square function, then the locations of the electric devices mark points on a parabolic curve. Other functions, in particular, functions with more than one argument, may be used. For example, if the winches fastened to a truss with a two- or three-dimensional distribution instead of being lined up along a pole 820, the chosen function may be a function of two or three arguments. In this case, the locations of the electric devices mark points on the graph of a two- or three-dimensional function.

It is to be understood that the different parts and components of the winch and system described above can also be implemented independently of each other and can be combined in different form. Furthermore, the above described embodiments are to be construed as exemplary embodiments only.

The invention claimed is:

1. A winch comprising:

a cable roll configured to wind and unwind a cable;

a cable having one end that is fixed to the cable roll, and another end that is configured to electrically connect an electric device to the cable, wherein the cable is further configured to provide the electric device with instruction data;

a framework to which the cable roll is mounted;

measuring means connected to the framework and configured to provide data related to the length of an unwound part of the cable; and processing means configured to control winding and unwinding of the cable based on the data provided by the measuring means, the processing means comprising a microprocessor and a storage with movement control software that enables the microprocessor to control movement of the cable roll, wherein the microprocessor is mounted within the framework;

wherein there is a predetermined fixed reference point on the cable, and there is a predetermined reference state of the cable, at which the predetermined fixed reference point is at a reference position in relation to a coordinate system, and wherein the length of unwound cable is defined as the distance measured along the cable, between the location of the predetermined fixed reference point and the reference position wherein the electric device is a light emitting device, and the storage comprises light control software that enables the processing means to control the light-emitting device by issuing and forwarding the instruction data to the light emitting device via the cable.

2. The winch according to claim 1 wherein the cable is a reinforced signal cable.

3. The winch according to claim 1 further comprising an electric motor, which is configured to set the cable roll into rotation, and wherein the processing means is configured to control the electric motor.

4. The winch according to claim 1 wherein the measuring means is configured to provide data related to the length of the unwound part of the cable based on the amount of cable which is wound around the cable roll.

5. The winch according to claim 1 wherein the measuring means comprise an encoder which is configured to provide data related to an angle by which the cable roll has rotated, with respect to the position of the cable roll corresponding to the reference state of the cable, and/or an angle which indicates the position of the cable roll.

6. The winch according to claim 1 wherein the processing means is configured to control the angular velocity of the cable roll, by taking into account data related to the length of the unwound part of the cable, and causing the predetermined fixed reference point on the cable to move with a predetermined linear velocity and/or acceleration.

7. The winch according to claim 1 wherein the winch further comprises a magnet which is attached to the cable and a magnet sensor which is configured to sense the magnetic field of the magnet.

8. The winch according to claim 7 wherein the processing means are configured to provide an auto setup function performable to bring the cable into the reference state.

9. The winch according to claim 1 further comprising an electric device which is pinned on the cable.

10. The winch according to claim 1 further comprising an interface configured to receive electric power and/or data from an external controller.

11. The winch according to claim 1 wherein the electric device comprising an interactivity sensor is electrically connected to the cable, and wherein the interactivity sensor is configured to forward data to the cable.

12. A system, comprising:

a plurality of winches according to claim 1; and a system controller configured to issue instructions to be executed by a winch to at least one of the plurality of winches, and/or to provide data and/or electric power to at least one electric device that is electrically connectable to the cable of a winch from the plurality of winches.

13. The system according to claim 12 further comprising data connection means, wherein the system controller is configured to use the data connection means to select at least one of the plurality of winches for communication, and to issue instructions to the at least one selected winch.

14. The system according to claim 12 further comprising an electric device that is electrically connected to the cables of at least two of the plurality of winches, wherein each of the at least two winches comprises a motor for driving the respective cable roll.

15. The winch according to claim 9 wherein the electric device comprises a light emitting device, a sound emitting device, a sensor, an actuator, or a motor.

16. The winch according to claim 11 wherein the data comprise instructions.

17. The winch according to claim 1 wherein the framework has an opening through which the cable may exit the framework, and wherein the reference position is located in the opening.

18. The winch according to claim 1 wherein the measuring means comprises a length tracking means that engages an outer circumference of the cable roll.

19. The winch according to claim 1 wherein the cable is further configured to provide the electric device with electric power.

* * * * *